United States Patent [19]

Kishimoto et al.

[11] Patent Number: 4,798,784

[45] Date of Patent: Jan. 17, 1989

[54] METHOD FOR PROCESSING A SILVER HALIDE COLOR PHOTOGRAPHIC MATERIAL INCLUDING A HYDROLYZABLE TYPE DIR COUPLER INCLUDING BLEACHING AND BLEACH-FIXING PROCESSING

[75] Inventors: Shinzo Kishimoto; Toshihiro Nishikawa; Akira Abe; Junya Nakajima, all of Kanagawa, Japan

[73] Assignee: Fuji Photo Film Co., Ltd., Kanagawa, Japan

[21] Appl. No.: 935,494

[22] Filed: Nov. 26, 1986

[30] Foreign Application Priority Data

Nov. 26, 1985 [JP] Japan ..... 60-265915

[51] Int. Cl.[4] ..... G03C 7/00; G03C 5/38; G03C 5/44; G03C 7/32

[52] U.S. Cl. ..... 430/382; 430/219; 430/240; 430/393; 430/400; 430/430; 430/446; 430/486; 430/506; 430/544; 430/957

[58] Field of Search ..... 430/506, 957, 382, 400, 430/430, 393, 219, 240, 446, 486, 544

[56] References Cited

U.S. PATENT DOCUMENTS

| | | | |
|---|---|---|---|
| 4,255,510 | 3/1981 | Simons et al. | 430/382 |
| 4,286,054 | 8/1981 | Englemann et al. | 430/382 X |
| 4,368,255 | 1/1983 | Borg | 430/382 |
| 4,477,560 | 10/1984 | Koitabashi et al. | 430/553 X |
| 4,605,611 | 8/1986 | Ohno et al. | 430/393 |
| 4,695,529 | 9/1987 | Abe et al. . | |
| 4,717,647 | 1/1988 | Abe et al. | 430/393 |

FOREIGN PATENT DOCUMENTS

| | | |
|---|---|---|
| 1459171 | 12/1976 | United Kingdom . |
| 1531927 | 11/1978 | United Kingdom . |

OTHER PUBLICATIONS

⊕=Equivalent to Coerman 2,626,315.

*Primary Examiner*—Mukund J. Shah

*Attorney, Agent, or Firm*—Sughrue, Mion, Zinn, Macpeak & Seas

[57] ABSTRACT

A method for processing a silver halide color photographic material which comprises, after color development of an exposed silver halide color photographic material containing a hydrolyzable type DIR coupler, rapidly processing the developed silver halide color photographic material with a liquid having a bleaching ability and subsequently with a liquid having a bleach-fixing ability, to thereby form a color image.

In accordance with the method for processing a silver halide color photographic material, desilveration is completed in a short period of time and color photographic images having excellent color reproducibility and fastness are obtained.

20 Claims, No Drawings

METHOD FOR PROCESSING A SILVER HALIDE COLOR PHOTOGRAPHIC MATERIAL INCLUDING A HYDROLYZABLE TYPE DIR COUPLER INCLUDING BLEACHING AND BLEACH-FIXING PROCESSING

FIELD OF THE INVENTION

The present invention relates to a method for processing a silver halide color photographic material, and more particularly, to a method for processing a silver halide color photographic material, in which desilveration is sufficiently conducted in a short period of time, and which provides a color image having improved color reproducibility.

BACKGROUND OF THE INVENTION

The fundamental steps of processing color photographic light-sensitive materials generally include a color development step and a desilvering step. In the color development step, exposed silver halide is reduced with a color development agent to form silver and the oxidized color developing agent reacts with a color former (coupler) to yield a dye image. In the subsequent desilvering step, the silver thus formed is oxidized with a bleaching bath, further changed into a soluble silver complex by the function of a fixing agent, and then dissolved away.

In addition to these fundamental steps of color development processing described above, actual development processing involves various auxiliary steps for maintaining the photographic and physical quality of the resulting image and for improving the preservability of the image. For example, there are illustrated a hardening bath, a stopping bath, an image stabilizing bath, a water washing bath, etc.

In recent years, it has been strongly desired to accelerate the processing, that is, to shorten the processing time. With the above-described color development processing, there is a strong need to shorten the time for the desilvering step, which typically occupies nearly one half of the total processing time.

In response to such a need for reducing the time for the desilvering step, there have been known a bleach-fixing solution, which contains an aminopolycarboxylic acid ferric ion complex salt and a thiosulfate in a single solution, as described in German Pat. No. 866,605. However, the bleaching power of the solution is remarkably decreased, since an aminopolycarboxylic acid ferric ion complex salt, which per se is weak in oxidizing power (bleaching power), and a thiosulfate, which has a reducing power, are coexistent in a single solution. Therefore, it is very difficult for such bleach-fixing solution to sufficiently achieve desilveration of color photographic materials for photography of high sensitivity and high silver content, and consequently it can not be employed for practical use.

On the other hand, for the purpose of increasing the bleaching power, there has been proposed a method wherein various bleach accelerators such as mercapto compounds, for example, those described in U.S. Pat. No. 3,893,858, etc. are added to the bleaching bath, the bleach-fixing bath or a prebath thereof. However, effects of these bleach accelerators are not necessarily sufficient when they are employed in a conventional processing method including a bleaching bath and a fixing bath.

Further, an attempt to accelerate desilveration has been made by the method wherein a color photographic material is processed, after color development, with a bleaching bath and subsequently with a bleach-fixing bath, as described in Japanese Patent Application (OPI) Nos. 7352/86 and 7353/86.

However, it has been found that another problem occurs, in which desilveration is rather deteriorated depending on the kind of DIR (development inhibitor releasing) couplers included in color photographic materials, when they are subjected to processing with a bleaching bath and subsequently with a bleach-fixing bath.

SUMMARY OF THE INVENTION

Therefore, one object of the present invention is to provide a method suitable for accelerating desilveration of a color photographic light-sensitive material and for forming an excellent color image.

Another object of the present invention is to provide a color photographic light-sensitive material suitable for reducing a processing time thereof.

A further object of the present invention is to provide a method for forming a color image having excellent fastness upon a rapid processing.

Other objects of the present invention will become apparent from the following description and examples.

These objects of the present invention are accomplished by a method for processing a silver halide color photographic material which comprises, color developing an exposed silver halide color photographic material containing a hydrolyzable type DIR coupler, rapidly processing the developed silver halide color photographic material with a liquid having a bleaching ability, and subsequently with a liquid having a bleach-fixing ability, whereby a color image is formed.

DETAILED DESCRIPTION OF THE INVENTION

The hydrolyzable type DIR coupler which can be used in the present invention is a coupler having at its coupling active position a group which acts as a compound having a development inhibiting function (i.e., a development inhibitor) or precursor thereof when released from the coupling active position of the coupler upon a color development reaction and which is capable of being decomposed to a compound having substantially no effect on photographic properties after being discharged into a color developing solution. The development inhibitor or precursor thereof should have a certain decomposition rate coefficient. More specifically, a half-life period of the development inhibitor or precursor thereof at pH 10.0 is 4 hours or less, preferably 2 hours or less, and more preferably 1 hour or less.

Measurement of a half-life period of the development inhibitor or precursor thereof in the present invention can be easily carried out in the following manner. That is, a development inhibitor or precursor thereof to be measured is added to a developing solution having the composition shown below in an amount of $1\times10^{-4}$ mol/liter, the solution is maintained at 38° C. and the concentration of the remaining development inhibitor or precursor thereof is determined by liquid chromatography, whereby the half-life period of the development inhibitor or precursor thereof is determined.

Composition of Developing Solution:

| | |
|---|---|
| Diethylenetriaminepentaacetic Acid | 0.8 g |
| 1-Hydroxyethylidene-1,1-diphosphonic Acid | 3.3 g |
| Sodium sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 liter |
| | pH 10.0 |

Any hydrolyzable type DIR coupler which satisfies the half-like period condition described above can be employed in the present invention. More specifically, hydrolyzable type DIR couplers represented by the following general formula (I) can be used. ps $$A\{(L_1)_a—Z\{L_2—Y)_b]_m \quad (I)$$

wherein A represents a coupler residue; Z represents a fundamental portion of a compound having a development inhibiting function which is connected directly (when a is 0) or through a linking group $L_1$ (when a is 1) with the coupling position of the coupler; Y is connected with Z through a linking group $L_2$ and represents a substituent capable of generating the development inhibiting function of Z; $L_1$ represents a linking group; $L_2$ represents a linking group including a chemical bond which is cleaved in a developing solution; a represents 0 or 1; b represents 1 or 2, when b represents 2, the two $—L_2—Y$ groups may be the same or different; and m represents 1 or 2.

The compound represented by formula (I) may release $^{\theta}Z\{L_2—Y)_b$ or $^{\theta}L_1—Z\{L_2—Y)_b$ after the coupling reaction with an oxidation product of a color developing agent. The latter changes immediately into $^{\theta}Z\{L_2—Y)_b$ by releasing $L_1$. The $^{\theta}Z\{L_2—Y)_b$ diffuses in the light-sensitive layer while exhibiting the development inhibiting function and a part thereof discharges into the color developing solution. The $^{\theta}Z\{L_2—Y)_b$ discharged into the color developing solution rapidly decomposes at the chemical bond included in $L_2$; that is, the connection between Z and Y is cleaved, whereby a compound which has a small development inhibiting function and which has a water-soluble group in Z remains in the color developing solution, and thus the development inhibiting function substantially disappears.

Hydralyzable type DIR couplers represented by formula (I) are described in more detail below.

Preferred examples of yellow color image forming coupler residues represented by A include those of pivaloyl acetanilide type, benzoyl acetanilide type, malonic diestertype, malondiamide type, dibenzoylmethane type, benzothiazolyl acetamide type, malonic ester monoamide type, benzothiazolyl acetate type, benzoxazolyl acetamide type, benzoxazolyl acetate type, benzimidazolyl acetamide type and benzimidazolyl acetate type; the coupler residues derived from hetero ring-substituted acetamides or hetero ring-substituted acetates involved in U.S. Pat. No. 3,841,880; the coupler residues derived from the acyl acetamides as described in U.S. Pat. No. 3,770,446, British Pat. No. 1,459,171, West German Patent Application (OLS) No. 2,503,099, Japanese Patent Application (OPI) No. 139738/75 and *Research Disclosure,* No. 15737; and the hetero ring type coupler residues as described in U.S. Pat. No. 4,046,574, etc.

Preferred examples of magenta color image forming coupler residues represented by A include those of 5-oxo-2-pyrazoline type, pyrazolo[1,5-a]-benzimidazole type and cyanoacetophenone type; and coupler residues having a pyrazolotriazole nucleus, etc.

Preferred examples of cyan color image forming coupler residues represented by A include those having a phenol nucleus or an α-naphthol nucleus.

Further, DIR couplers which release a development inhibitor upon coupling with an oxidation product of a developing agent and substantially does not form a dye are employed.

Suitable examples of such a type of coupler residues represented by A include the coupler residues as described in U.S. Pat. Nos. 4,052,213, 4,088,491, 3,632,345, 3,958,993, and 3,961,959, etc.

The fundamental portion of a development inhibitor represented by a Z includes a divalent nitrogen-containing heterocyclic group or nitrogen-containing thio group. Suitable examples of heterocyclic thio groups include a tetrazolylthio group, a benzothiazolylthio group, a benzimidazolylthio group, a triazolylthio group, and an imidazolylthio group, etc. Suitable examples of Z are set forth below, including showing the positions of substitution of the $A\{L_1)_a$ group and the $\{L_2—Y)_b$ group.

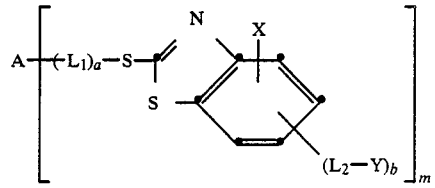

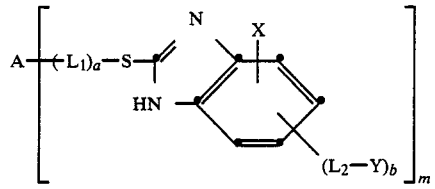

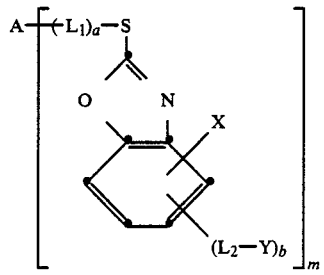

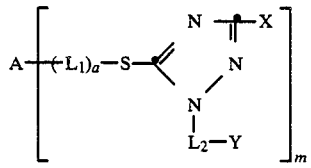

-continued

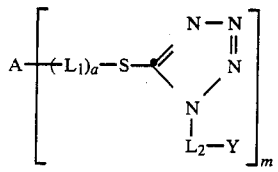

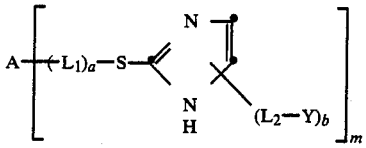

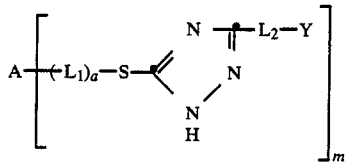

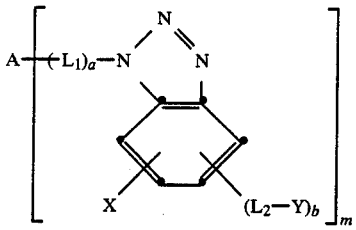

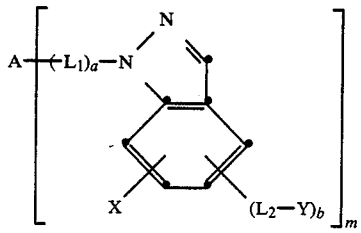

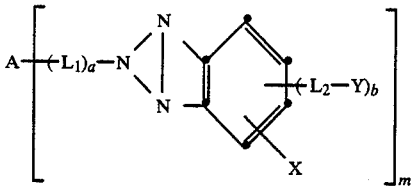

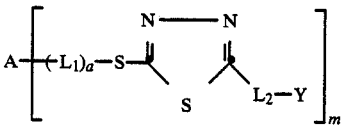

In the above described formulae, the substituent represented by X, which is included as a portion of Z in the formula (I), represents a hydrogen atom, a halogen atom, an alkyl group, an alkenyl group, an alkanamido group, an alkenamido group, an alkoxy group, a sulfonamido group or an aryl group.

Suitable examples of the group represented by Y in formula (I) include an alkyl group, a cycloalkyl group, an alkenyl group, a cycloalkenyl group, an aryl group, an aralkyl group, a heterocyclic group, etc.

Suitable examples of the linking group represented by $L_1$ in formula (I) are set forth below, together with A and $Z—(L_2—Y)_b$.

$$A\text{-}[OCH_2—Z—(L_2—Y)_b]_m$$

(a linking group as described in U.S. Pat. No. 4,146,396)

$$A\text{-}[SCH_2—Z—(L_2Y)_b]_m$$

$$A\text{-}[\overset{O}{\overset{\|}{C}}O—Z—(L_2—Y)_b]_m$$

(a linking group as described in West German Patent Application (OLS) No. 2,626,315)

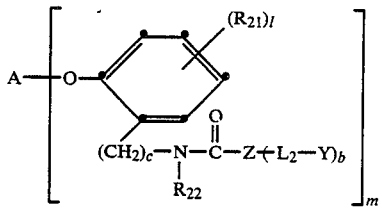

(the linking group as described in West German Patent Application (OLS) No. 2,885,697; c represents an integer from 0 to 2)

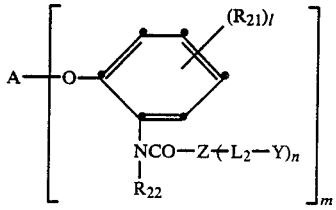

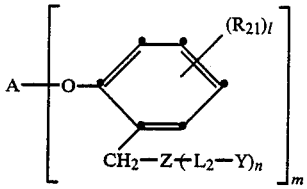

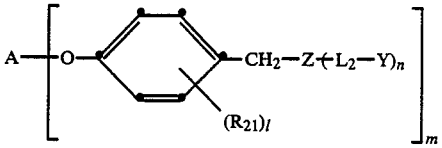

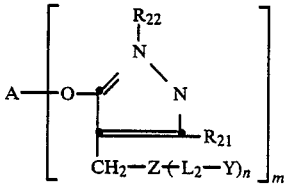

In the above described formulae, $R_{21}$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a cycloalkyl group, an alkanesulfonyl group, an arylsulfonyl group or an acyl group; $R_{22}$ represents a hydrogen atom, an alkyl group, an alkenyl group, an aralkyl group, a cycloalkyl group or an aryl group; n and l each represents 1 or 2, and when l represents 2, the two $R_{21}$ groups may be bonded to each other to form a condensed ring.

With these DIR couplers (i.e., cases wherein "a" represents 1 in formula (I)), a releasing group released upon the reaction with an oxidation product of a developing agent decomposes immediately and releases a development inhibitor $[H—Z—(L_2—Y)_b]$. Therefore these couplers have the same effect in accordance with the present invention as DIR couplers which do not contain the group represented by $L_1$ (i.e., cases wherein "a" represents 0 in the general formula (I)) have.

The linking group represented by $L_2$ in the general formula (I) includes a chemical bond which is cleaved in a developing solution. Suitable examples of such chemical bonds include those described in the table below. These chemical bonds are cleaved with a nucleophilic reagent such as a hydroxy ion or a hydroxylamine, etc., which is a component of the color developing solution. Thereby the desired effect of the present invention is attained.

TABLE

| Chemical Bond Included in $L_2$ | Cleavage Reaction of Chemical Bond (Reaction with —OH) |
|---|---|
| —COO— | —COOH + HO— |
| H<br>—NCOO— | —$NH_2$ + HO— |
| —$SO_2$O—<br>—$OCH_2CH_2SO_2$— | —$SO_3H$ + HO—<br>—OH + $CH_2$=$CHSO_2$— |
| —OC(=O)— | —OH + HO— |
| —NHC(=O)C(=O)— | —$NH_2$ + HO— |

The divalent linking group shown in the Table above is connected directly or through an alkylene group and/or a phenylene group with Z, and connected directly with Y. When the divalent linking group is connected through an alkylene group and/or a phenylene group, the alkylene group and/or phenylene group may contain an ether bond, an amido bond, a carbonyl group, a thioether bond, a sulfone group, a sulfonamido bond, or a ureido bond.

Preferred examples of the linking group represented by $L_2$ and the bonding thereof to Z and Y are set forth below.

—Z—$(CH_2)_d$—COO—Y

—Z—$(CH_2)_d$—OC(=O)—Y

-continued

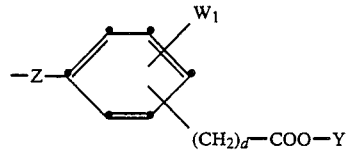

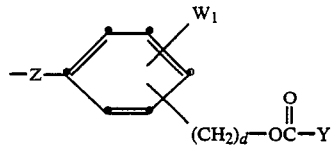

—Z—$(CH_2)_d$—NHCOO—Y

—Z—$(CH_2)_d$—OC(=O)NH—Y

—Z—NHC(=O)—$(CH_2)_d$C(=O)—Y

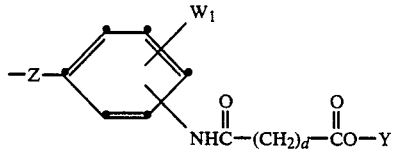

—Z+$CH_2)_p$—$COOCH_2CH_2SO_2$—Y

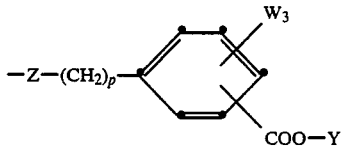

—Z—NCOO—Y
|
$W_2$

—Z—N—COCO—Y
|
$W_2$

In the above described formulae, d represents an integer from 0 to 10, preferably from 0 to 5; $W_1$ represents a hydrogen atom, a halogen atom, an alkyl group having from 1 to 10, preferably from 1 to 5 carbon atoms, an alkanamido group having from 1 to 10, preferably from 1 to 5 carbon atoms, an alkoxy group having from 1 to 10 preferably from 1 to 5 carbon atoms, an alkoxycarbonyl group having from 1 to 10, preferably from 1 to 5 carbon atoms, an aryloxycarbonyl group, an alkanesulfonamido group having from 1 to 10, preferably 1 to 5 carbon atoms, an aryl group, a carbamoyl group, a nitro group, a cyano group, an arylsulfonamido group, a sulfamoyl group or an imido group; $W_2$ represents a hydrogen atom, an alkyl group having from 1 to 6 carbon atoms, an aryl group or an alkenyl group; $W_3$ represents a hydrogen atom, a halogen atom, a nitro group, an alkoxy group having from 1 to 6 carbon atoms or an alkyl group having from 1 to 6 carbon atoms; and p represents an integer from 0 to 6.

The alkyl group or the alkenyl group represented by X or Y specifically represents a straight chain, branched chain or cyclic alkyl group or alkenyl group having 1 to 10, preferably 1 to 5 carbon atoms, and preferably has a substituent. Examples of the substituents include a halogen atom, a nitro group, an alkoxy group having from 1 to 4 carbon atoms, an aryloxy group having from 6 to 10 carbon atoms, an alkanesulfonyl group having from 1 to 4 carbon atoms, an arylsulfonyl group having from 6 to 10 carbon atoms, an alkanamido group having from 1 to 5 carbon atoms, an anilino group, a benzamido group, a carbamoyl group, a carbamoyl group substituted with an alkyl group having from 1 to 6 carbon atoms, a carbamoyl group substituted with an aryl group having from 6 to 10 carbon atoms, an alkylsulfonamido group having from 1 to 4 carbon atoms, an arylsulfonamido group having from 6 to 10 carbon atoms, al alkylthio group having from 1 to 4 carbon atoms, an arylthio group having from 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, a alkylamino group having from 1 to 4 carbon atoms, an alkanoyl group having from 1 to 4 carbon atoms, a benzoyl group, an alkanoyloxy group having from 1 to 4 carbon atoms, a benzoloxy group, a perfluoroalkyl group having from 1 to 4 carbon atoms, a cyano group, a tetrazolyl group, a hydroxy group, a carboxy group, a mercapto group, a sulfo group, an amino group, an alkylsulfamoyl group having from 1 to 4 carbon atoms, an arylsulfamoyl group having from 6 to 10 carbon atoms, a morpholino group, an aryl group having from 6 to 10 carbon atoms, a pyrrolidinyl group, a ureido group, a urethane group, a carbonyl group substituted with an alkoxy group having from 1 to 6 carbon atoms, a carbonyl group substituted with an aryloxy group having from 6 to 10 carbon atoms, an imidazolidinyl group or an alkylidenamino group having from 1 to 6 carbon atoms, etc.

The alkanamido group or the alkenamido group represented by X specifically represents a straight chain, branched chain or cyclic alkanamido group or alkenamido group having from 1 to 10, and preferably from 1 to 5 carbon atoms which may be substituted. Examples of the substituents are selected from the substituents as defined for the above described alkyl group or alkenyl group, etc.

The alkoxy group represented by X specifically represents a straight chain, branched chain or cyclic alkoxy group having from 1 to 10, and preferably from 1 to 5, carbon atoms which may be substituted. Examples of the substituents are selected from the substituents as defined for the above described alkyl group or alkenyl group, etc.

The aryl group represented by X or Y specifically represents a phenyl group or a naphthyl group which may be substituted. Examples of the substituents are selected from the substituents as defined for the above described alkyl group or alkenyl group and an alkyl group having from 1 to 4 carbon atoms, etc.

The heterocyclic group represented by Y include a diazolyl group (for example, a 2-imidazolyl group, a 4-pyrazolyl group, etc.), a triazolyl group (for example, a 1,2,4-triazol-3-yl group, etc.), a thiazolyl group (for example, a 2-benzothiazolyl group, etc.), an oxazolyl group (for example, 1,3-oxazol-2-yl group, etc.), a pyrrolyl group, a pyridyl group, a diazinyl group (for example, a 1,4-diazin-2-yl group, etc.), a triazinyl group (for example, a 1,2,4-triazin-5-yl group, etc.), a furyl group, a diazolinyl group (for example, an imidazolin-2-yl group, etc.), a pyrrolinyl group, or a thienyl group, etc.

Of the couplers represented by the general formula (I), preferred couplers are those represented by the general formula (II), (III), (IV), (V), (VI), (VII) or (VIII) shown below. These couplers are preferred since the development inhibiting function of development inhibitor released therefrom is strong.

(II)

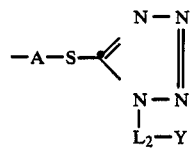

(III)

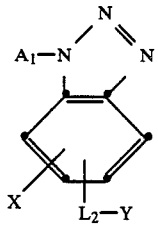

(IV)

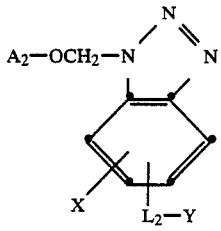

(V)

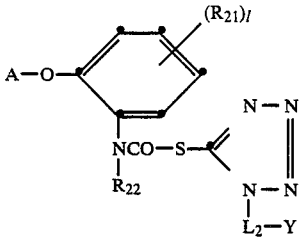

(VI)

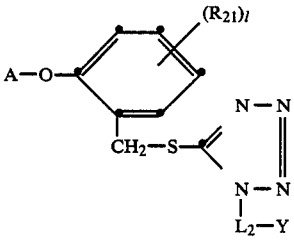

(VII)

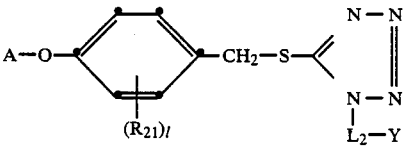

-continued (VIII)

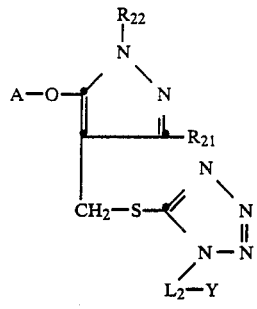

In the above described formulae (II) and (V) to (VIII), A, $L_2$ and Y each has the same meaning as defined in formula (I).

In the above described general formula (III), $A_1$ represents the coupler residue as defined for A in formula (I), excluding cyan color image forming coupler residues.

In the above described formula (IV), $A_2$ represents a cyan color image forming coupler residue of the coupler residues as defined for A in formula (I).

In the above described formulae (III) and (IV), X, $L_2$ and Y each has the same meaning as defined in formula (I).

Further, the effects of the present invention are particularly exhibited when couplers represented by formula (IX), (X), (XI), (XII), (XIII), (XIV), (XV), (XVI), (XVII), (XVIII), or (XIX) described below are employed. These couplers are preferred because of their high coupling rates.

(IX)

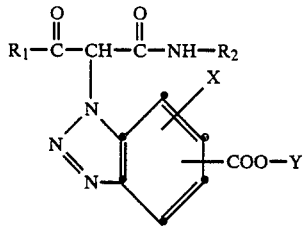

(X)

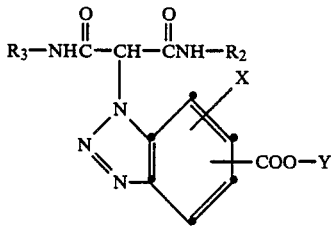

(XI)

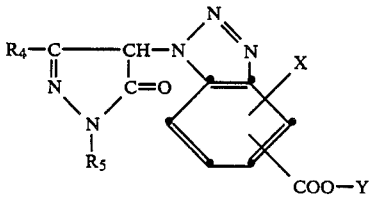

-continued (XII)

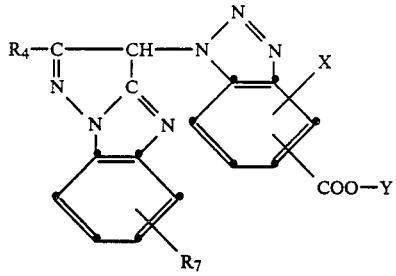

(XIII)

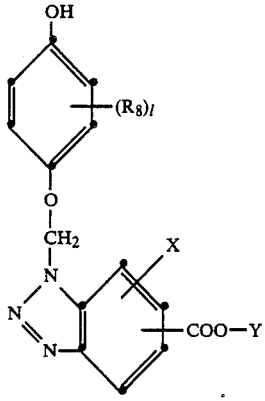

(XIV)

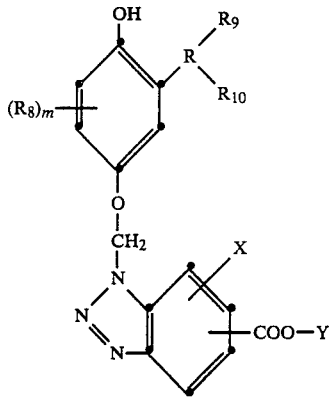

(XV)

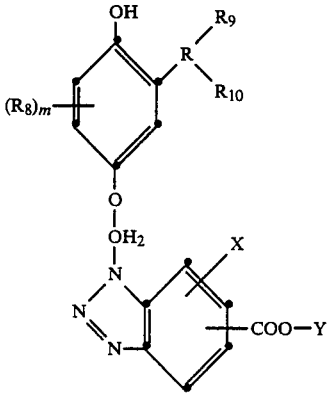

-continued (XVI)

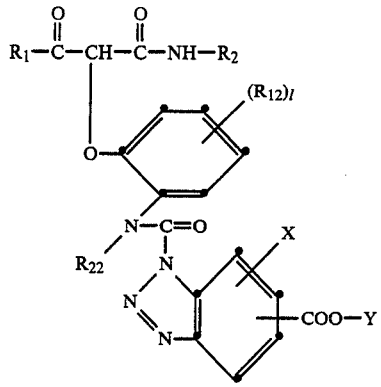

(XVII)

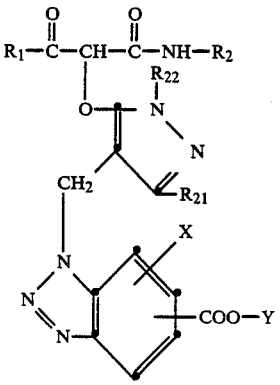

(XVIII)

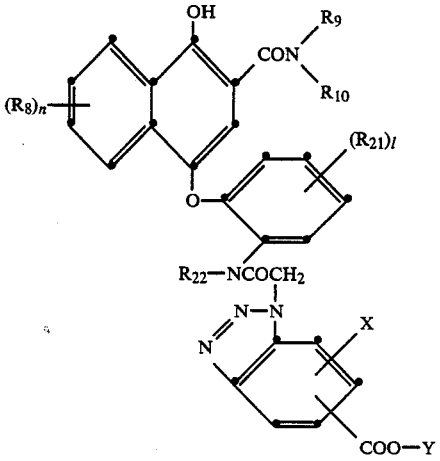

-continued (XIX)

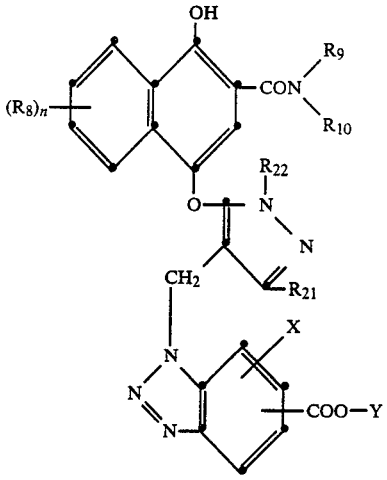

In the above described formulae, X and Y each has the same meaning as defined in the general formula (II) or (III).

In the above described general formulae, $R_1$ represents an aliphatic group, an aromatic group, an alkoxy group or a heterocyclic group; and $R_2$ and $R_3$ each represents an aromatic group or a heterocyclic group.

The aliphatic group represented by $R_1$ is preferably an aliphatic group containing from 1 to 22 carbon atoms, and may have substituents or not, and further, may have a chain form or a cyclic form. Preferable substituents therefor include an alkoxy group, an aryloxy group, an amino group, an acylamino group, a halogen atom, etc., each of which may further have a substituent(s). Specific examples of aliphatic groups useful for $R_1$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

In the case that $R_1$, $R_2$ or $R_3$ represents an aromatic group (especially a phenyl group), it may have a substituent. The aromatic group such as a phenyl group, etc. may be substituted with an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido, alkyl-substituted succinimido group, etc. each containing 32 or less carbon atoms. The alkyl group therein may include an alkyl group which contains an aromatic group such as phenylene in its chain. Further, a phenyl group represented by $R_1$, $R_2$ or $R_3$ may be substituted with an aryloxy group, an aryloxycarbonyl group, an arylcarbamoyl group, an arylamido group, an arylsulfamoyl group, an arylsulfonamido group, an arylureido group, etc., the aryl moiety of which groups each may be substituted with one or more alkyl groups wherein the number of carbon atoms is from 1 to 22 in total.

Furthermore, a phenyl group represented by $R_1$, $R_2$ or $R_3$ may be substituted with an amino group which may include an amino group sbustituted with a lower alkyl group having from 1 to 6 carbon atoms, a hydroxy group, a carboxy group, a sulfo group, a nitro group, a cyano group, a thiocyano group or a halogen atom.

In addition, $R_1$, $R_2$, or $R_3$ may represent a substituent formed by condensing a phenyl group and another ring, to form, for example, a naphthyl group, a guinolyl group, an isoquinolyl group, a chromanyl group, a coumaranyl group, a tetrahydronaphthyl group, etc. These substituents may further have substituents in themselves.

In the case that $R_1$ represents an alkoxy group, the alkyl moiety thereof represents a straight chain or branched chain alkyl group having from 1 to 40 carbon atoms, preferably from 1 to 22 carbon atoms, an alkenyl group, a cyclic alkyl group or a cyclic alkenyl group, each of which may be substituted with a halogen atom, an aryl group, an alkoxy group, etc.

In the case that $R_1$, $R_2$ or $R_3$ represents a heterocyclic group, the heterocyclic group is bonded to the carbon atom of the carbonyl group of the acyl moiety or the nitrogen atom of the amido moiety of an α-acylacetamido group through one of the carbon atoms forming the ring. Examples of such heterocyclic rings include thiophene, furan, pyran, pyrrole, pyrazole, pyridine, pyrazine, pyrimidine, pyridazine, indolizine, imidazole, thiazole, oxazole, triazine, thiadiazine, oxazine, etc. These rings may further have substituents on the individual rings.

In the above-described formula (XI), $R_5$ represents a straight chain or branched chain alkyl group having from 1 to 40 carbon atoms, preferably from 1 to 22 carbon atoms (e.g., a methyl group, an isopropyl group, a tert-butyl group, a hexyl group, a dodecyl group, etc.), an alkenyl group (e.g., an allyl group, etc.), a cyclic alkyl group (e.g., a cyclopentyl group, a cyclohexyl group, a norbornyl group, etc.), an aralkyl group (e.g., a benzyl group, a β-phenylethyl group, etc.), a cyclic alkenyl group (e.g., a cyclopentenyl group, a cyclohexenyl group, etc.), etc., which groups each may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an arloxycarbonyl group, a sulfo group, a sulfamoyl group, a carbamoyl group, an acylamino group, a diacylamino group, ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, etc.

$R_5$ may further represent an aryl group (e.g., a phenyl group, an α- or β-naphthyl group, etc.). The aryl group may have one or more substituents. Specific examples of the substituents include an alkyl group, an alkenyl group, a cyclic alkyl group, an aralkyl group, a cyclic alkenyl group, an halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, a N-arylanilino group, an N-acylanilino group, a hydroxy group, a mercapto group, etc. A more preferable group for $R_5$ is a phenyl group which is substituted with an alkyl group, an alkoxy group, a halogen atom, etc., at least one of the o-positions, because it is effective to restrain discoloration of couplers remaining in film layers due to light or heat.

Furthermore, $R_5$ may represent a heterocyclic group (e.g., a 5-membered or 6-membered heterocyclic ring containing as a hetero atom a nitrogen atom, an oxygen atom or a sulfur atom, or a condensed ring thereof, each specific examples including a pyridyl group, a quinolyl group, a furyl group, a benzothiazolyl group, an oxazolyl group, an imidazolyl group, a naphthoxazolyl group, etc.), a heterocyclic group substituted with one or more substituents as defined for the above-described aryl group, an aliphatic acyl group, an aromatic acyl group, an alkylsulfonyl group, an arylsulfonyl group, an alkylcarbamoyl group, an arylcarbamoyl group, an alkylthiocarbamoyl group or an arylthiocarbamoyl group.

In the above-described formulae, $R_4$ represents a hydrogen atom, a straight chain or branched chain alkyl group having from 1 to 40 carbon atoms, preferably from 1 to 22 carbon atoms, an alkenyl group, a cyclic alkyl group, an aralkyl group or a cyclic alkenyl group (each of which may have one or more substituents as defined for the above-described substituent $R_3$), an aryl group or a heterocyclic group (which each also may have one or more substituents as defined for the above-described substituent $R_5$), an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., a benzyloxycarbonyl group, etc.), an alkoxy group (e.g., a methoxy group, an ethoxy group, a heptadecyloxy group, etc.), an aryloxy group (e.g., a phenoxy group, a tolyloxy group, etc.), an alkylthio group (e.g., an ethylthio group, a dodecylthio group, etc.), an arylthio group (e.g., a phenylthio group, an α-naphtylthio group, etc.), a carboxy group, an acylamino group (e.g., an acetylamino group, a 3-[(2,4-di-tert-amylphenoxy)acetamido]benzamido group, etc.), a diacylamino group, an N-alkylacylamino group (e.g., an N-methylpropionamido group, etc.), an N-arylacylamino group (e.g., an N-phenylacetamido group, etc.), a ureido group (e.g., a ureido group, an N-arylureido group, an N-alkylureido group, etc.), a urethane group, a thiourethane group, an arylamino group (e.g., a phenylamino group, an N-methylanilino group, a diphenylamino group, a N-acetylanilino group, a 2-chloro-5-tetradecanemidoanilino group, etc.), an alkylamino group (e.g., a n-butylamino group, a methylamino group, a cyclohexylamino group, etc.), a cycloamino group (e.g., a piperidino group, a pyrrolidino group, etc.), a heterocyclic amino group (e.g., a 4-pyridylamino group, a 2-benzoxazolylamino group, etc.), an alkylcarbonyl group (e.g., a methylcarbonyl group, etc.), a sulfonamido group (e.g., an alkylsulfonamido group, an arylsulfonamido group, etc.), a carbamoyl group (e.g., an ethylcarbamoyl group, a dimethylcarbamoyl group, an N-methylphenylcarbamoyl group, an N-phenylcarbamoyl, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), a cyano group, a hydroxy group, a mercapto group, a halogen atom or a sulfo group.

In the above-described formula, $R_7$ represents a hydrogen atom, or a straight chain or branched chain alkyl group having from 1 to 32 carbon atoms, preferably from 1 to 22 carbon atoms, an alkenyl group, a cyclic alkyl group, an aralkyl group or a cyclic alkenyl group, each of which may have one or more substituents as defined for the above-described substituent $R_5$.

Further, $R_7$ may represent an aryl group or a heterocyclic group, which each may have one or more substituents as defined for the above-described substituent $R_5$.

Furthermore, $R_7$ may represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group.

In the above-described formulae, $R_8$, $R_9$ and $R_{10}$ each represents a group of a type which has been employed in conventional 4-equivalent type phenol or $\alpha$-naphthol couplers. Specifically, $R_8$ represents a hydrogen atom, a halogen atom, an aliphatic hydrocarbon group, an acylamino group, an —O—$R_{11}$ group or an —S—$R_{11}$ group (wherein $R_{11}$ is an aliphatic hydrocarbon residue). When two or more of the $R_8$ groups are present in one molecule, they may be different from each other. The above-described aliphatic hydrocarbon groups include those having substituents.

$R_9$ and $R_{10}$ each represents an aliphatic hydrocarbon groups, an aryl group or a heterocyclic group. Either of them may be a hydrogen atom. The above-described groups for $R_9$ and $R_{10}$ may further have certain substituents. Furthermore, $R_9$ and $R_{10}$ may combine with each other and form a nitrogen-containing heterocyclic nucleus. More specifically, the above-described aliphatic hydrocarbon residues include both saturated and unsaturated residues, wherein each may have a straight chain form, a branched chain form or a cyclic form. Preferred examples thereof include an alkyl group (e.g., a methyl group, an ethyl group, a propyl group, an isopropyl group, a butyl group, a tert-butyl group, an isobutyl group, a dodecyl group, an octadecyl group, a cyclobutyl group, a cyclohexyl group, etc.) and an alkenyl group (e.g., an allyl group, an octenyl group, etc.). The above-described aryl group includes a phenyl group, a naphthyl group, etc. Representatives of the above-described heterocyclic groups include a pyridinyl group, a quinolyl group, a thienyl group, a piperidyl group, an imidazolyl group, etc. These aliphatic hydrocarbon groups, aryl groups and heterocyclic groups each may be substituted with a halogen atom, a nitro group, a hydroxy group, a carboxy group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, a morpholino group, etc.

In the above-described formulae, l represents an integer of 1 to 4, m represents an integer of 1 to 3, and n represents an integer of 1 to 5.

Substituents $R_1$, $R_2$, $R_3$, $R_4$, $R_5$, $R_7$, $R_8$, $R_9$ and $R_{10}$ in the couplers represented by formulae (IX) to (XIX) may combine with each other or each of them may make a divalent group to form symmetric or asymmetric complex couplers.

Specific examples of the hydrolyzable type DIR couplers which can be used in the present invention are set forth below, but the present invention should not be construed as being limited thereto.

(1)

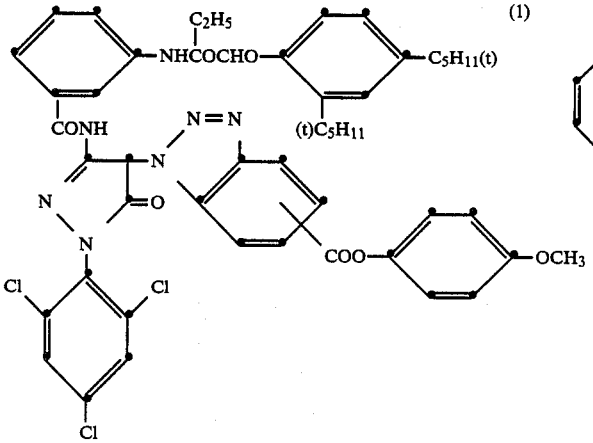

(2)

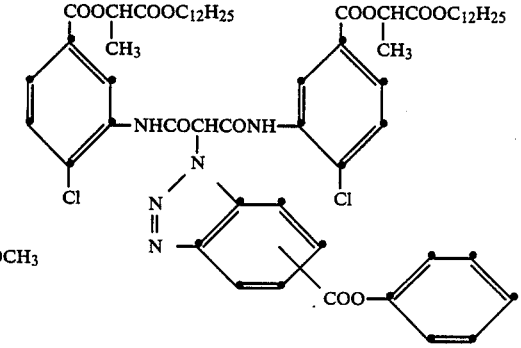

-continued
(3)
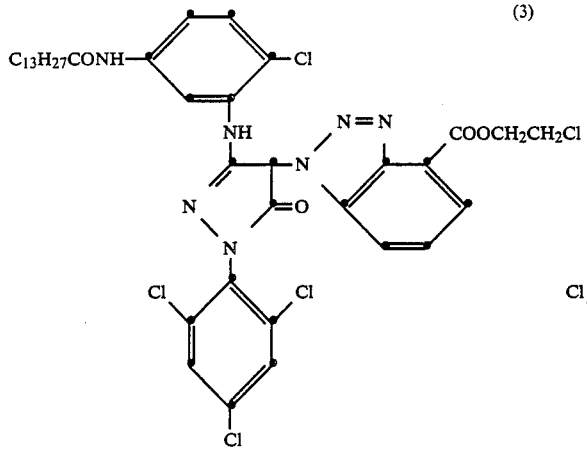
(4)
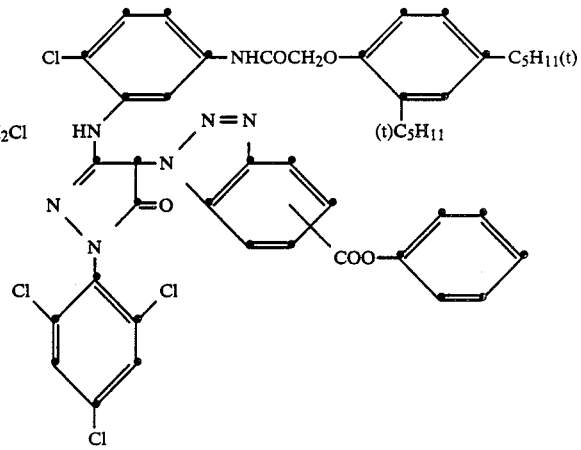
(5)
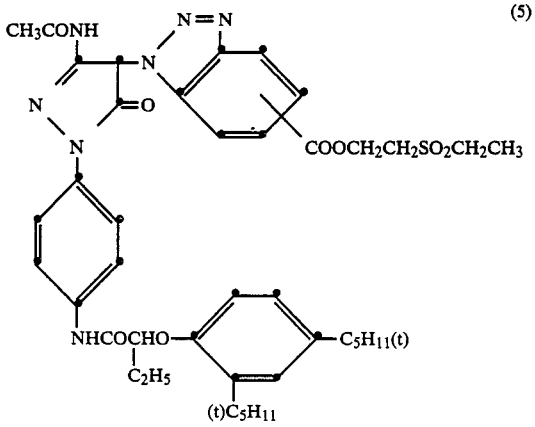
(6)
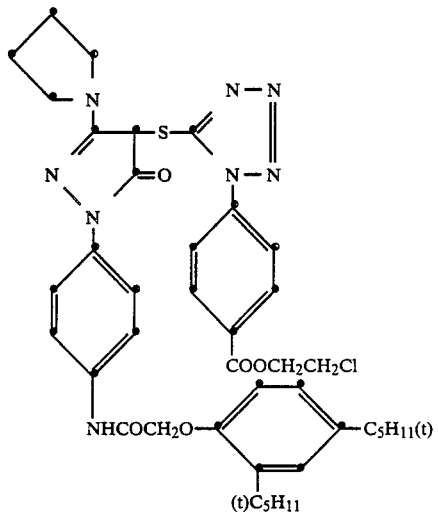
(7)
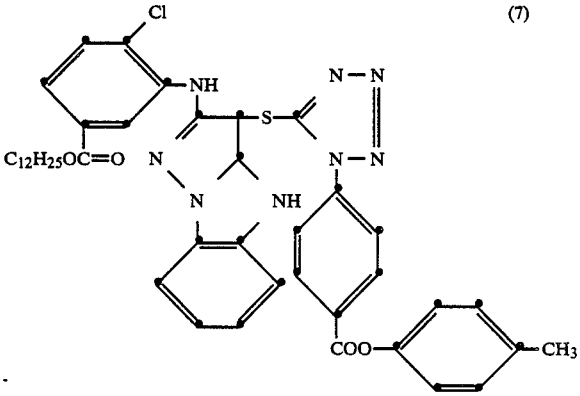
(8)
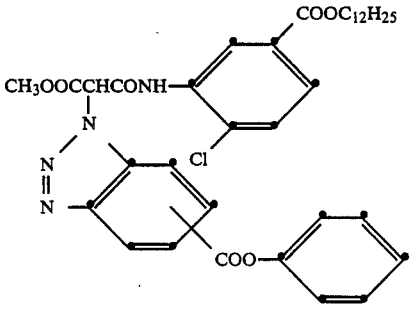

-continued
(9)
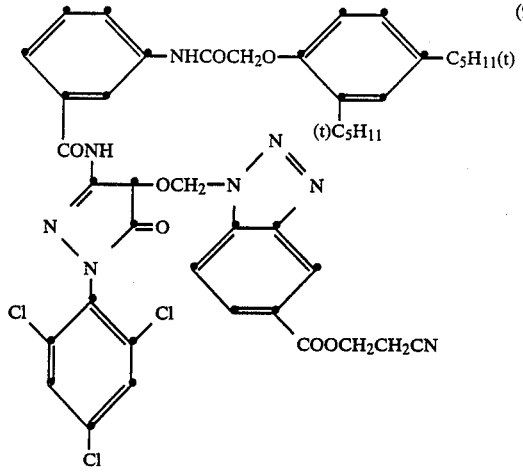
(10)
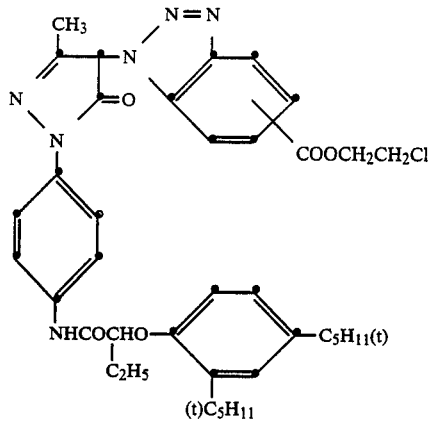
(11)
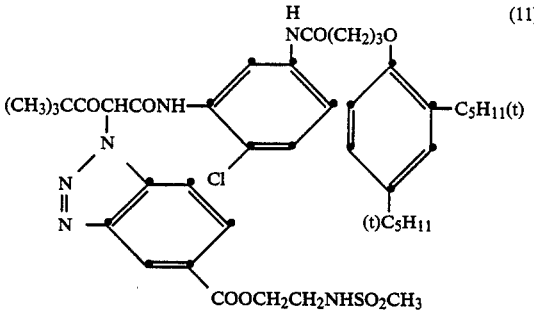
(12)
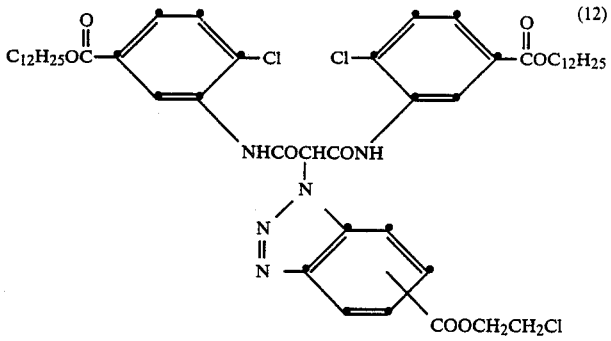
(13)
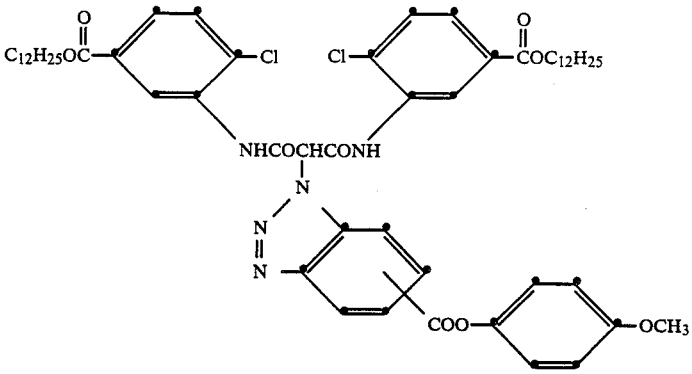
(14)
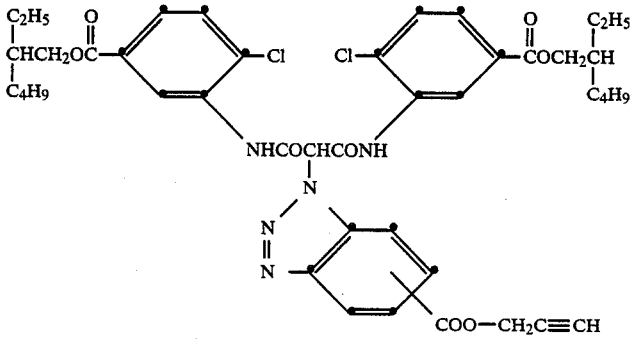

-continued
(15)
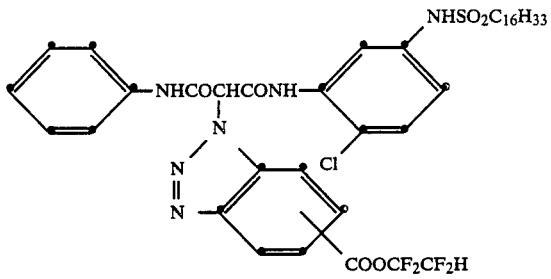
(16)
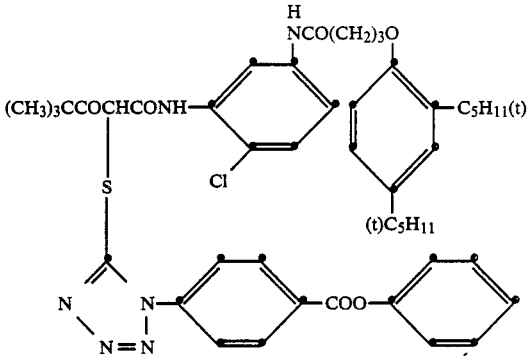
(17)
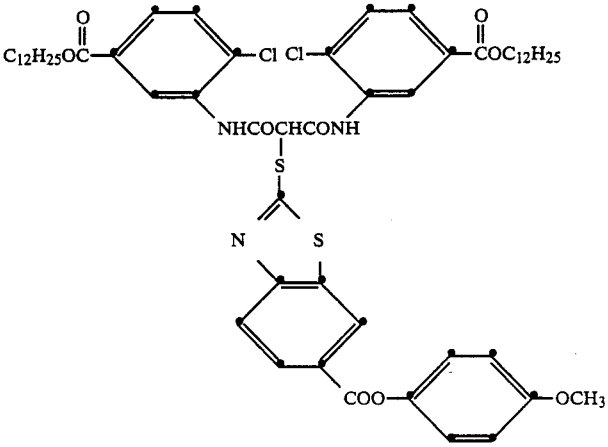
(18)
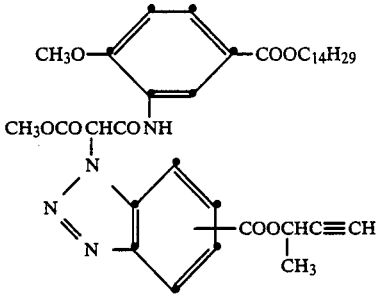
(19)
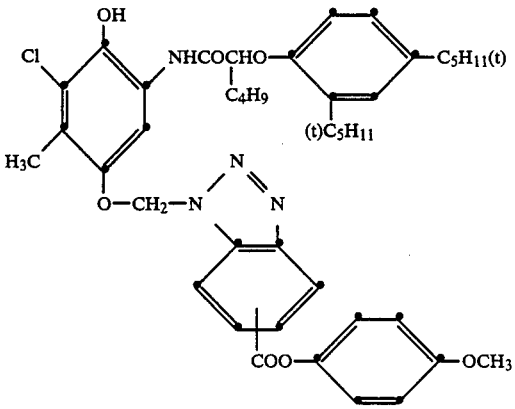
(20)
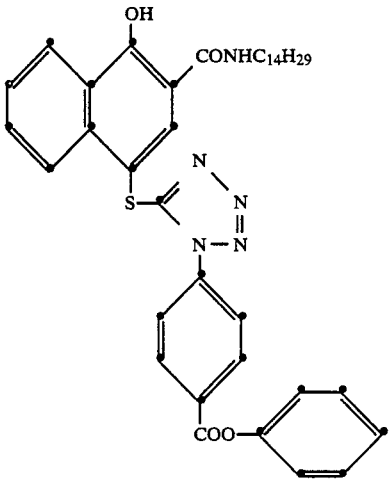

-continued
(21)
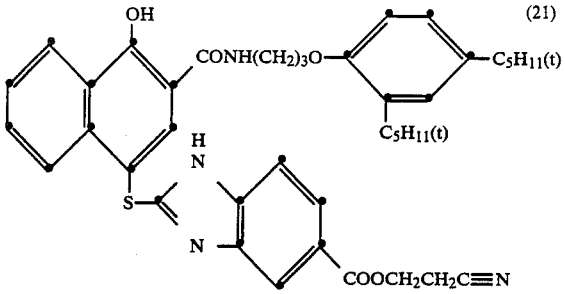
(22)
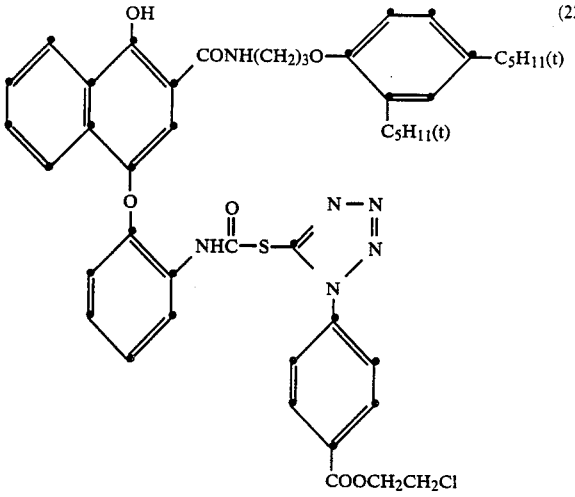
(23)
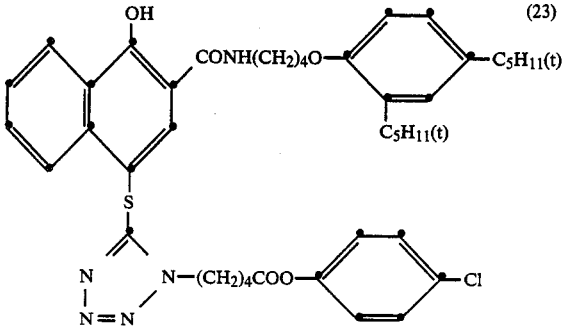
(24)
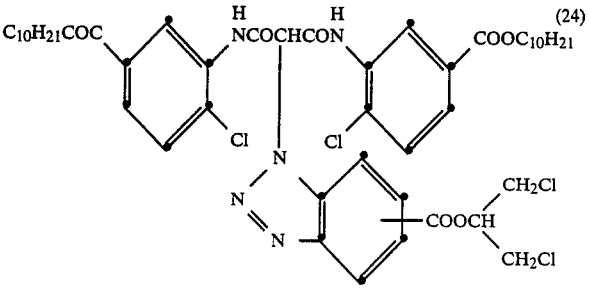
(25)
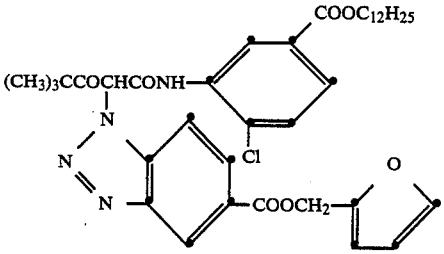
(26)
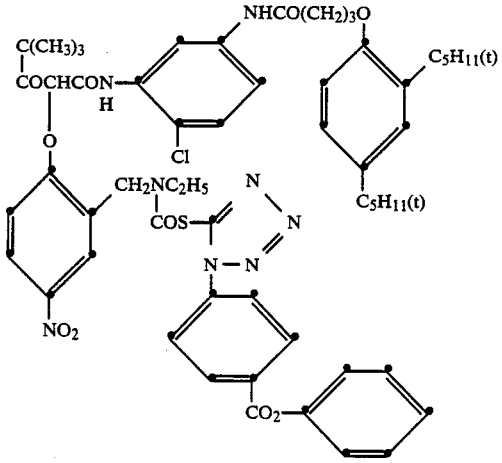

-continued (27)

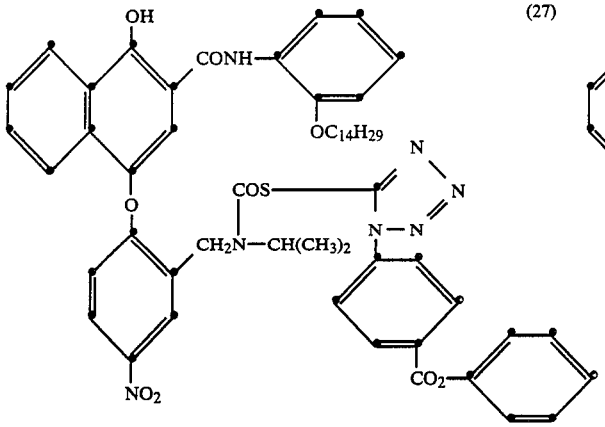

(28)

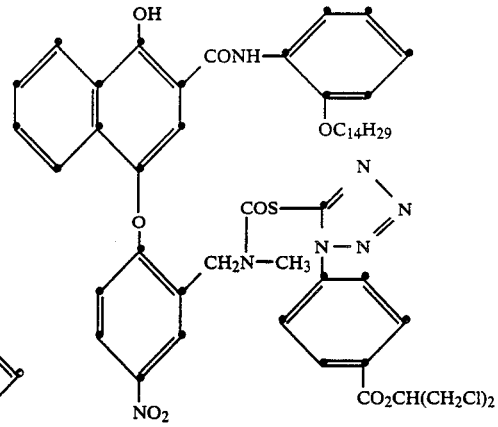

(29)

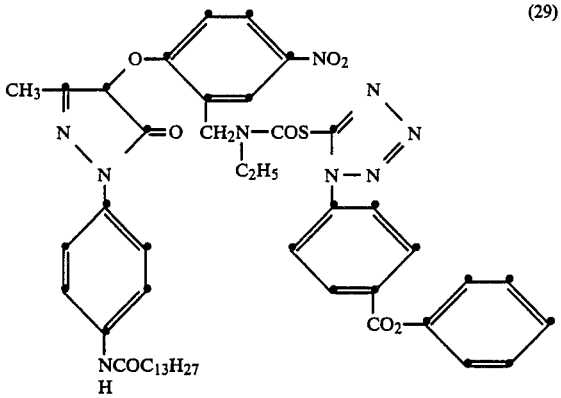

(30)

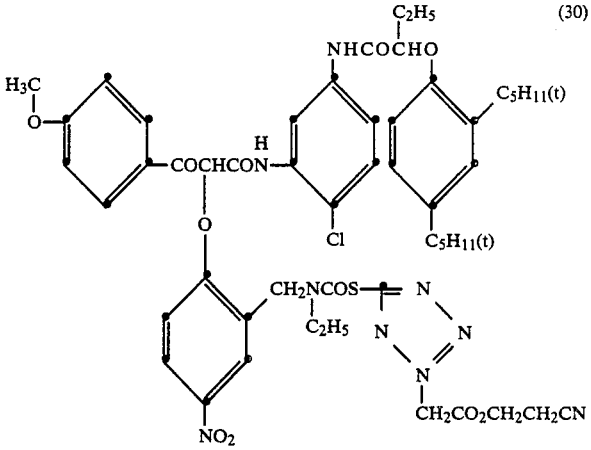

(31)

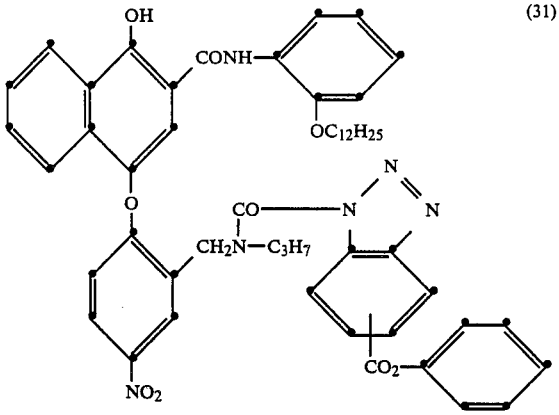

(32)

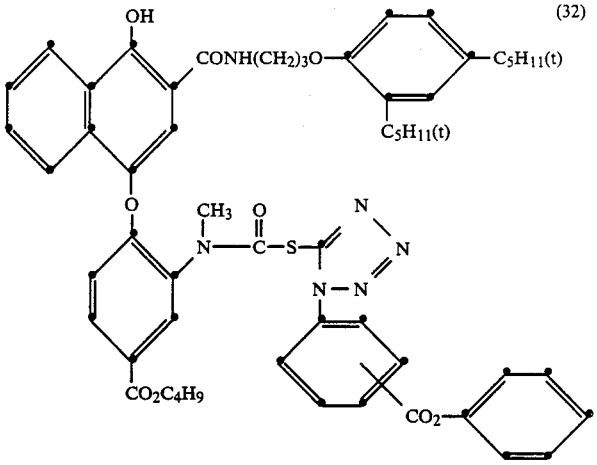

The specific examples of the couplers described above each has a half-life period of 4 hours or less at a pH of 10. The half-life period of these couplers can be easily determined by the method as described hereinbefore. The half-life periods determined are shown with respect to some couplers in the following table.

| Coupler No. | Half-Life Period (min) |
|---|---|
| (1) | 10 |
| (2) | 4.5 |
| (3) | 120 |

-continued

| Coupler No. | Half-Life Period (min) |
|---|---|
| (4) | 4.5 |
| (6) | 120 |
| (7) | 11 |
| (8) | 4.5 |
| (9) | 3 |
| (13) | 11 |
| (14) | 20 |
| (15) | 4.3 |
| (24) | 30 |

-continued

| Coupler No. | Half-Life Period (min) |
|---|---|
| (27) | 4.5 |

The hydrolyzable type DIR couplers which can be employed in the present invention are known compounds and can be easily synthesized according to the methods as described, for example, in Japanese Patent Application (OPI) Nos. 151944/82 and 205150/83, etc.

The desilvering step which is conducted after color development according to the present invention is now described in further detail.

The terminology "liquid having a bleaching ability" (hereinafter referred simply to as a bleaching liquid) means a liquid (e.g., in the form of a bath) which contains a bleaching component and has an ability of bleaching developed silver. More specifically the bleaching bath is a bath capable of bleaching at least more than ½, preferably ⅔ or more, and more preferably 4/5 or more of the maximum amount of developed silver contained in the color photographic light-sensitive material. The bleaching solution is a processing bath which desilvers only less than ½, preferably ⅓ or less, and more preferably 1/5 or less of the total coating amount of silver contained in the color photographic light-sensitive material.

The terminology "liquid having a bleach-fixing ability" (hereinafter referred to simply as a bleach-fixing liquid) means a liquid (e.g., in the form of a bath) which is capable of bleaching the remaining developed silver which is not bleached in the bleaching bath and desilvering it together with the remaining silver salt which is not desilbered by the bleaching liquid and which contains a bleaching agent in an amount of 0.05 mols or more per liter. More specifically, the bleach-fixing liquid is a liquid (e.g., in the form of a bath) which bleaches only less than ½, preferably ⅓ or less, and more preferably 1/5 or less of the maximum amount of developed silver contained in the color photographic light-sensitive material. The bleach-fixing solution is a processing liquid capable of desilvering at least more than ½, preferably ⅔ or more, and more preferably 4/5 or more of the total coating amount of silver contained in the color photographic light-sensitive material.

In accordance with the present invention, it is possible to conduct an extremely rapid processing by means of subjecting an exposed silver halide color photographic material containing a hydrolyzable type DIR coupler, after color development, to processing with the above-described both having a bleaching ability and subsequently with the above-described bath having a bleach-fixing ability. It is supposed that this is because the above-described hydrolyzable type DIR couplers used in the present invention decompose in a developing solution and do not adversely effect desilveration.

The above-described bleaching solution and bleach-fixing solution may each be composed of two or more liquid baths, provided that the total number of the baths is 4 or less. Further, a water washing step (including a water washing bath using a small amount of water for reducing the amount of washing water) may be provided between the bleaching bath and the bleach-fixing bath. Moreover, the overflow solution which flows out of the bleaching bath when the bleaching replenisher is added thereto may be introduced directly or indirectly into the subsequent bleach-fixing bath. It is particularly preferred to directly introduce the overflow solution into the bleach-fixing bath. By means of such an introduction, it is possible to reduce bleaching agent being replenished to the bleach-fixing bath.

According to the present invention, any of known bleaching agents, for example, a ferricyanide, a dichromate, a persulfate, an inorganic ferric salt, an organic acid ferric salt, etc., can be employed in the bleaching bath or the bleach-fixing bath. However, an aminopolycarboxylic acid ferric ion complex salt is preferred because of its low water pollution, low metal corrosion and good stability. The aminopolycarboxylic acid ferric ion complex salt is a complex of ferric ion and an aminopolycarboxylic acid or a salt thereof.

Typical examples of the aminopolycarboxylic acids and salts thereof are set forth below, but the present invention should not be construed as being limited thereto.

A-1 Ethylenediaminetetraacetic acid
A-2 Disodium ethylenediaminetetraacetate
A-3 Diammonium ethylenediaminetetraacetate
A-4 Tetra(trimethylammonium)ethylenediaminetetraacetate
A-5 Tetrapotassium ethylenediaminetetraacetate
A-6 Tetrasodium ethylenediaminetetraacetate
A-7 Trisodium ethylenediaminetetraacetate
A-8 Diethylenetriaminepentaacetic acid
A-9 Pentasodium diethylenetriaminepentaacetate
A-10 Ethylenediamine-N-(β-oxyethyl)-N,N',N'-triacetic acid
A-11 Trisodium ethylenediamine-N-(β-oxyethyl)-N,N',N'-triacetate
A-12 Triammonium ethylenediamine-N-(β-oxyethyl)-N,N',N'-triacetate
A-13 Propylenediaminetetraacetic acid
A-14 Disodium propylenediaminetetraacetate
A-15 Nitrilotriacetic acid
A-16 Trisodium nitrilotriacetate
A-17 Cyclohexanediaminetetraacetic acid
A-18 Disodium cyclohexanediaminetetraacetate
A-19 Iminodiacetic acid
A-20 Dihydroxyethylglycine
A-21 Ethyl ether diaminetetraacetic acid
A-22 Glycol ether diaminetetraacetic acid
A-23 Ethylenediaminetetrapropionic acid Among these compounds, A-1, A-2, A-3, A-8 and A-17 are particularly preferred.

The aminopolycarboxylic acid ferric ion complex salt may be used in the form of a complex salt per se or it may be formed in a solution by using a ferric salt such as ferric sulfate, ferric chloride, ferric nitrate, ferric ammonium sulfate, ferric phosphate, etc. with the aminopolycarboxylic acid. The complex salt may be used alone or as a combination of two or more thereof in case of using in the form of a complex salt. On the other hand, when a complex salt is formed in a solution using a ferric salt and an aminopolycarboxylic acid, one, two or more ferric salts may be used and one, two or more aminopolycarboxylic acids may be used. In any case, an aminopolycarboxylic acid may be employed in an excess amount of being necessary for forming a ferric ion complex salt.

The bleaching solution or the bleach-fixing solution containing the ferric ion complex salt may contain other metallic ion complex salts than iron, such as cobalt, copper, etc.

The bleaching liquid and bleach-fixing liquid used in the present invention may contain, in addition to the bleaching agent and the compounds mentioned above, rehalogenating agents such as bromides for example, potassium bromide, sodium bromide, ammonium bromide, etc., or chlorides, for example, potassium chloride, sodium chloride, ammonium chloride, etc. Furthermore, the bleaching liquid and bleach-fixing liquid may contain one or more inorganic acids, organic acids and salts thereof having the ability of buffering a pH, for example, nitrates such as sodium nitrate, ammonium nitrate, etc., boric acid, borax, sodium metaborate, acetic acid, sodium acetate, sodium carbonate, potassium carbonate, phosphorus acid, phosphoric acid, sodium phosphate, citric acid, sodium citrate, tartaric acid, or the like, and compounds having a fixing ability, for example, thiosulfates such as sodium thiosulfate, ammonium thiosulfate, ammonium sodium thiosulfate, potassium thiosulfate, etc., thiocyanates such as sodium thiocyanate, ammonium thiocyanate, potassium thiocyanate, etc., thiourea, thioethers, or the like.

Moreover, various additives may be added to the bleaching bath and the bleach-fixing bath according to the present invention, if desired. For example, sulfites such as sodium sulfite, ammonium sulfite, etc., various defoaming agents, surface active agents, iodides such as potassium iodide, sodium iodide, ammonium iodide, etc., hydroxylamine, hydrazine, addition products of aldehyde with bisulfite may be added.

The amount of the bleaching agent contained in the bleaching liquid used in the present invention is from 0.1 to 1 mol per liter, preferably from 0.2 to 0.5 mol per liter of the bleaching liquid. The pH of the bleaching liquid is preferably from 4.0 to 8.0, when used.

In the bleach-fixing bath used in the present invention, the amount of the bleaching agent is from 0.05 to 0.5 mol per liter, preferably 0.1 to 0.3 mol per liter of the bleach-fixing liquid, and the amount of the fixing agent is from 0.3 to 3 mols per liter, and preferably from 0.5 to 2.5 mols per liter of the bleach-fixing liquid. The pH of the bleach-fixing solution is from 5 to 9, preferably from 6 to 8.0.

To either one or both of the bleaching bath and the bleach-fixing bath used in the present invention, a bleach accelerator may be added. In particular, the bleach accelerators represented by formula (AI), (AII), (AIII), (AIV), (AV), (AVI), (AVII), (AVIII), or (AIX) described below are preferably used in the present invention.

It is preferred that such bleach accelerators are included in the bleaching bath.

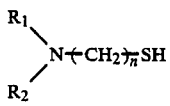
(AI)

In formula (AI), $R_1$ and $R_2$, which may be the same or different, each represents a hydrogen atom, a substituted or unsubstituted lower alkyl group (preferably having 1 to 5 carbon atoms, particularly, a methyl group, an ethyl group or a propyl group) or an acyl group (preferably having 1 to 3 carbon atoms such as an acetyl group, a propionyl group, etc.), or $R_1$ and $R_2$ may be bonded to each other to form a ring; and n represents an integer from 1 to 3.

The substituted or unsubstituted lower alkyl group is particularly preferred for $R_1$ and $R_2$. Examples of substituents for the substituted group represented by $R_1$ or $R_2$ include a hydroxy group, a carboxy group, a sulfo group, an amino group, etc.

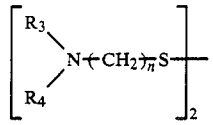
(AII)

In the formula (AII), $R_3$ and $R_4$ each has the same meaning as defined for $R_1$ and $R_2$ in formula (AI) or may be bonded to each other to form a ring; and n represents an integer of from 1 to 3.

The substituted or unsubstituted lower alkyl group is particularly preferred for $R_3$ and $R_4$. Examples of substituents for the substituted group represented by $R_3$ or $R_4$ include a hydroxy group, a carboxy group, a sulfo group, an amino group, etc.

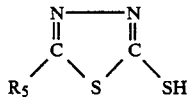
(AIII)

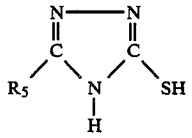
(AIV)

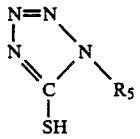
(AV)

In formula (AIII), (AIV), and (AV), $R_5$ represents a hydrogen atom, a halogen atom (for example, a chlorine atom, a bromine atom, etc.), an amino group, a substituted or unsubstituted lower alkyl group (preferably having 1 to 5 carbon atoms, and particularly, preferably methyl group, ethyl group, or proyl group) or an amino group substituted with an alkyl group (for example, a methylamino group, an ethylamino group, a dimethylamino group, a diethylamino group, etc.).

Examples of substituents for the substituted group represented by $R_5$ include a hydroxy group, a carboxy group, a sulfo group or an amino group, etc.

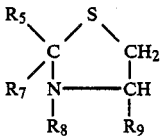
(AVI)

In formula (AVI), $R_6$ and $R_7$ (which may be the same or different) each represents a hydrogen atom, a substituted or unsubstituted alkyl group (preferably a lower alkyl group, for example, a methyl group, an ethyl group or a propyl group, etc.), a substituted or unsubstituted phenyl group or a substituted or unsubstituted heterocyclic group (more specifically, a heterocyclic group having one or more hetero atoms such as a nitrogen atom, an oxygen atom or a sulfur atom, etc., for example, a pyridine ring, a thiophene ring, a thiazolidine ring, a benzoxazole ring, a benzotriazole ring, a thiazole ring, an imidazole ring, etc.); $R_8$ represents a hydrogen atom or a substituted or unsubstituted lower alkyl group (preferably having from 1 to 3 carbon atoms, for example, a methyl group or an ethyl group, etc.); and $R_9$ represents a hydrohgen atom or a carboxy group.

Examples of substituents for the substituted group represented by $R_6$, $R_7$ or $R_8$ include a hydroxy group, a carboxy group, a sulfo group, an amino group or a lower alkyl group, etc.

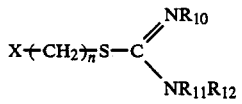

(AVII)

In formula (AVII), $R_{10}$, $R_{11}$, and $R_{12}$ (which may be the same or different), each represents a hydrogen atom or a lower alkyl group (preferably having from 1 to 3 carbon atoms, for example, a methyl group or an ethyl group, etc.), or $R_{10}$ and $R_{11}$ or $R_{12}$ may be bonded to each other to form a ring; X represents a substituted or unsubstituted amino group (examples of substituents including a lower alkyl group such as a methyl group, etc., and an acetoxyalkyl group such as an acetoxymethyl group, etc.), a sulfo group or a carboxy group; and n represents an integer from 1–5.

A hydrogen atom, a methyl group or an ethyl group is particularly preferred for $R_{10}$, $R_{11}$ or $R_{12}$, and an amino group or a dialkylamino group is preferred for X.

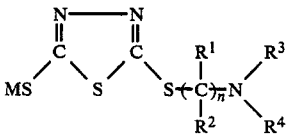

(AVIII)

In formula (AVIII), $R^1$ and $R^2$ (which may be the same or different), each represents a hydrogen atom, a hydroxy group, a substituted or unsubstituted amino group, a carboxy group, a sulfo group or a substituted or unsubstituted alkyl group; $R^3$ and $R^4$ (which may be the same or different) each represents a hydrogen atom, a substituted or unsubstituted alkyl group or a substituted or unsubstituted acyl group, or $R^3$ and $R^4$ may be bonded to each other to form a ring; M represents a hydrogen atom, an alkali metal atom or an ammonium group, and n represents an integer from 2 to 5.

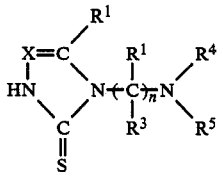

(AIX)

In formula (AIX), X represents N or C-R; R, $R^1$, $R^2$ and $R^3$, which may be the same or different, each represents a hydrogen atom, a halogen atom, an amino group, a hydroxy group, a carboxy group, a sulfo group or a substituted or unsubstituted alkyl group; $R^4$ and $R^5$ (which may be the same or different) each represents a hydrogen atom, a substituted or unsubstituted alkyl group or a substituted or unsubstituted acyl group, or $R^4$ and $R^5$ may be bonded to each other to form a ring, provided that both $R^4$ and $R^5$ are not hydrogen atoms; and n represents an integer of from 0 to 5.

The amount of the bleach accelerator added is from $1\times10^{-4}$ to $1\times10^{-1}$ mol per liter, and preferably from $1\times10^{-3}$ to $5\times10^{-2}$ mol per liter of the bleaching solution or the bleach-fixing solution.

In the present invention, the bleaching time is preferably in a range from 20 seconds to 4 minutes. In the case of using a bleach accelerator, the bleaching time ranging from 40 seconds to 2 minutes is more preferred. On the other hand, the bleaching time ranging from 1 minute and 30 seconds to 4 minutes is more preferred, when such a bleach accelerator is not employed.

The bleach-fixing time is preferably in a range from 1 minute to 5 minutes and more preferably in a range from 1 minute and 30 seconds to 3 minutes and 30 seconds.

The color development processing in the present invention can be conducted in a known manner.

A primary aromatic amine color developing agent to be used in the present invention in a color developing solution include a wide range of known developing agents for use in various color photographic processes. The color developing agents include aminophenol derivatives and p-phenylenediamine derivatives. These compounds are generally used in the form of salts such as hydrochlorides or sulfates rather than in free form in view of stability advantages. They are generally used in an amount of from about 0.1 g to about 30 g, more preferably from about 1 g to about 15 g, per liter of color developing solution.

The aminophenol type developing agents include, for example, o-aminophenol, p-aminophenol, 5-amino-2-oxytoluene, 2-amino-3-oxytoluene, 2-oxy-3-amino-1,4-dimethylbenzene, etc.

Particularly useful primary aromatic amine type color developing agents are N,N-dialkyl-p-phenylenediamine compounds where the alkyl group and the phenyl group may or may not be substituted. Of these, particularly useful compounds are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, 4-amino-N-(2-methoxyethyl)-N-ethyl-3-methylaniline p-toluenesulfonate, etc.

The alkaline color developing solution used in the present invention can optionally contain, in addition to the above described primary aromatic amine color developing agent, various ingredients usually added to a color developing solution, such as alkali agents (e.g., sodium hydroxide, sodium carbonate, potassium carbonate, etc.), alkali metal sulfites, alkali metal bisulfites, alkali metal thiocyanates, alkali metal halides, benzyl alcohol, water-softening agents, thickening agents, etc. The pH of the color developing solution is generally 7 to above, and most typically from about 9 to about 13.

The method according to the present invention is applicable to color reversal processing. In the present invention, as a black-and-white developing solution to be used in such processing, a black-and-white first developing solution used for reversal processing of color photographic light-sensitive materials or a developing solution used for processing black-and-white photographic light-sensitive materials can be used. In addition, various well known additives generally added to a black-and-white developing solution can be incorporated in the solution.

Typical additives include developing agents such as 1-phenyl-3-pyrazolidone, metol, and hydroquinone; preservatives such as sulfites; accelerators comprising alkalis such as sodium hydroxide, sodium carbonate, potassium carbonate, etc.; inorganic or organic inhibitors such as potassium bromide, 2-methylbenzimidazole, methylbenzothiazole, etc.; water-softening agents such as polyphosphoric acid salts; and a slight amount of development inhibitors comprising iodides or mercapto compounds.

In the pressent invention, a conventional water washing step in which water for washing is supplied in an amount exceeding 50 times the amount of processing solution carried over from the preceding bath per unit area of color photographic material or a water washing step in which water for washing is supplied in an amount not more than 50 times of the amount of processing solution carried over from the preceding bath per a unit area of color photographic material.

In water for use in the water washing step, various sterilizers or antimolds are included for the purpose of preventing the generation of slime or molds. Further, various chelating agents such as ethylenediaminetetraacetic acid, nitrilotriacetic acid, etc. may be added to water as water-softening agents.

In the present invention, the water washing step may be composed of only one tank or a countercurrent water washing process using two or more tanks. The latter is more preferred in view of saving water resources.

The amount of the washing water required for the water washing step may be broadly varied depending on a number of tanks for water washing employed and is usually in a range from about 50 ml to about 100 liters per $m^2$ of color photographic light-sensitive material. The optimum amount can be calculated based on the description in S. R. Goldwasser, "Water Flow Rates in Immersion-Washing of Motion Picture Film" in *Journal of the Society of Motion Picture and Television Engineers,* Vol. 64, pages 248 to 253 (May 1955).

The washing water according to the present invention usually has a pH of around 7. However, the pH of the washing water may vary in a range from 3 to 9 due to the carrying in of the preceding bath. Further, temperature of the washing water is in a range from 5° C. to 40° C., and preferably from 10° C. to 35° C. In a water washing tank, a heater, a temperature controller, a circulation pump, a filter, a floating cover, a squeezer, etc. may be provided, if desired.

In the present invention, the water washing time is usually in a range from 20 seconds to 5 minutes, preferably in a range from 30 seconds to 3 minutes, and particularly preferably in a range from 30 seconds to 2 minutes. While the effect of the present invention can be attained by any water washing time, it is particularly remarkably obtained when the water washing time is shortened.

As a stabilizing solution used in a stabilizing step, a processing solution for stabilizing dye images can be employed. For example, a solution having a buffering function to maintain a pH of 3 to 6, a solution containing an aldehyde (for example, formalin, etc.), etc. can be employed. In the stabilizing solution, a fluorescent whitening agent, a chelating agent, a sterilizer, an antimold, a hardening agent, a surface active agent, etc. may be used, if desired.

The silver halide photographic emulsion of the color photographic light-sensitive material used in the present invention can be prepared using appropriately known methods, for example, those as described in *Research Disclosure,* Vol. 176, No. 17643 (December 1978), pages 22 to 23, "I. Emulsion Preparation and Types" and ibid., Vol. 187, No. 18716 (November 1979), page 648, etc.

In the preparation of photographic emulsion, various silver halide solvents (for example, ammonia, potassium thiocyanate, and thioethers and thione compounds as described in U.S. Pat. No. 3,271,157, Japanese patent application (OPI) Nos. 12360/76, 82408/78, 144319/78, 100717/79 and 155828/79, etc.) may be employed, if desired.

During the step of formation or physical ripening of silver halide grains, cadmium salts, zinc salts, lead salts, thallium salts, iridium salts or complex salts thereof, rhodium salts or complex salts thereof, iron salts or complex salts thereof, etc. may be present.

The photographic emulsions in the present invention are usually conducted with physical ripening, chemical ripening and spectral sensitization. Various kinds of additives which can be employed in thse steps are described in *Research Disclosure,* No. 17643 (December 1978) and ibid., No. 18716 (November 1979) as mentioned above and concerned items thereof are summarized in the table shown below.

Further, known photographic additives which can be used in the present invention are also described in the above mentioned *Research Disclosure,* RD No. 17643 (December 1978) and RD No. 18716 (November 1979) and concerned items thereof are summarized in the table shown below.

| Kind of Additives | RD17643 | RD18716 |
|---|---|---|
| 1. Chemical Sensitizers | p. 23 | p. 648, right column |
| 2. Sensitivity Increasing Agents | " | " |
| 3. Spectral Sensitizers and Super Sensitizers | pp. 23–24 | p. 648, right column to p. 649, right column |
| 4. Whitening Agents | p. 24 | |
| 5. Antifoggants and Stabilizers | pp. 24–25 | p. 649, right column |
| 6. Light-Absorbers, Filter Dyes, and Ultraviolet Ray Absorbers | pp. 25–26 | p. 649, right column to p. 650, left column |
| 7. Antistaining Agents | p. 25, right column | p. 650, left column to right column |
| 8. Dye Image Stabilizers | p. 25 | |
| 9. Hardeners | p. 26 | p. 651, left column |
| 10. Binders | p. 26 | " |
| 11. Plasticizers and Lubricants | p. 27 | p. 650, right column |
| 12. Coating Aids, and Surfactants | pp. 26–27 | " |

-continued

| Kind of Additives | RD17643 | RD18716 |
|---|---|---|
| 13. Antistatic Agents | p. 27 | " |

As typical yellow couplers useful in the color photographic light-sensitive material used in the present invention, hydrophobic acylacetamide type couplers having a ballast group are exemplified. Specific examples thereof are described in U.S. Pat. Nos. 2,407,210, 2,875,057 and 3,265,506, etc.

In the method of the present invention two-equivalent yellow couplers are preferably employed. Typical examples of two-equivalent yellow couplers include yellow couplers of oxygen atom releasing type as described in U.S. Pat. Nos. 3,408,194, 3,447,928, 3,933,501 and 4,022,620, etc. and yellow couplers of nitrogen atom releasing type as described in Japanese Patent Publication No. 10739/83, U.S. Pat. Nos. 4,401,752 and 4,326,024, *Research Disclosure,* No. 18053 (April 1979), British Pat. No. 1,425,020, West German patent application (OLS) Nos. 2,219,917, 2,261,361, 2,329,587 and 2,433,812, etc. α-Pivaloylacetanilide type couplers are characterized by fastness, particularly light fastness, of the dyes formed, and α-benzoylacetanilide type couplers are characterized by providing a high color density.

As cyan couplers useful in the color photographic light-sensitive material used in the present invention, hydrophobic and diffusion-resistant naphthol type and phenol type couplers are exemplified. Typical examples thereof include naphthol type couplers as described in U.S. Pat. No. 2,474,293 and preferably oxygen atom releasing type two-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers capable of forming cyan dyes fast to humidity and temperature are preferably used in the present invention. Typical examples thereof include phenol type cyan couplers having an alkyl group having at least 2 carbon atoms at the metha-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German patent application (OLS) No. 3,329,729, and European Pat. No. 121,365, etc., phenol type couplers having a phenylureido group at the 2-position thereof and an acylamino group at the 5-position thereof as described in U.S. Pat. Nos. 3,446,622, 4,333,999, 4,451,559 and 4,427,767, etc. Further, cyan couplers of naphthol type having a sulfonamido group or an amido group, etc. at the 5-position thereof as described in Japanese patent application Nos. 93605/84, 264277/84 and 268135/84 are also preferably employed in the present invention because of excellent fastness of color images formed therefrom.

Typical examples of cyan couplers which can be employed together with the above-described cyan couplers include naphthol type couplers as described in U.S. Pat. No. 2,474,293 and preferably oxygen atom releasing type two-equivalent naphthol type couplers as described in U.S. Pat. Nos. 4,052,212, 4,146,396, 4,228,233 and 4,296,200, etc.

In the present invention, it is preferred to use colored couplers for masking together in color photographic light-sensitive materials for photographing in order to correct undesirable absorptions of dyes formed. Specific examples of useful colored couplers are described in Research Disclosure, No. 17643 (December 1978), "VII-g", as mentioned above.

Furthermore, couplers capable of forming appropriately diffusible dyes can be used together in order to improve graininess. Specific examples of such types of magenta couplers are described in U.S. Pat. No. 4,366,237 and British Pat. No. 2,125,570, etc. and those of yellow, magenta and cyan couplers are described in European Pat. No. 96,570 and West German patent application (OLS) No. 3,234,533, etc.

Dye forming couplers and the above described special couplers may form polymers, including dimers and oligomers Typical examples of polymerized dye forming couplers are described in U.S. Pat. Nos. 3,451,820 and 4,080,211, etc. Specific examples of polymerized magenta couplers are described in British Pat. No. 2,102,173 and U.S. Pat. No. 4,367,282, etc.

Couplers capable of releasing a photographically useful residue during the course of coupling can also be employed preferably in the present invention. Specific examples of useful DIR couplers capable of releasing a development inhibitor are described in the patents cited in *Research Disclosure,* No. 17643 (Dec. 1978), "VII-F" as mentioned above.

The cyan couplers according to the present invention are employed in an amount of from 0.002 mols to 0.5 mols per mol of light-sensitive silver halide present in a layer into which the couplers are incorporated in order to achieve the objects of the present invention.

The couplers which can be used in the present invention can be incorporated into photographic light-sensitive materials using various known dispersing methods. Typical examples thereof include a solid dispersing method, an alkali dispersing method, preferably a latex dispersing method and more preferably an oil droplet in water type dispersing method. By means of the oil droplet in water type dispersing method, couplers are dissolved in either an organic solvent having a high boiling point of 175° C. or more, a so-called auxiliary solvent having a low boiling point, or a mixture thereof, and then the solution is finely dispersed in an aqueous medium such as water or an aqueous gelatin solution, etc. in the presence of a surface active agent. Specific examples of the organic solvents having a high boiling point are described in U.S. Pat. No. 2,322,027, etc. Further, dispersions are utilized for coating after removing or reducing the auxiliary solvent therein by distillation, noodle washing or ultrafiltration, etc., if desired.

The color photographic light-sensitive material used in the present invention may contain hydroquinone derivatives, aminophenol derivatives, amines, gallic acid derivatives, catechol derivatives, ascorbic acid derivatives, non-color-forming couplers, sulfonamidophenol derivatives, etc., as color fog preventing agents or color mixing preventing agents.

In the color photographic light-sensitive material used in the present invention, various color fading preventing agents can be employed. Typical examples of organic color fading preventing agents include hindered phenols, for example, hydroquinones, 6-hydroxychromans, 5-hydroxycoumarans, spirochromans, p-alkoxyphenols, bisphenols, etc., gallic acid derivatives, methylenedioxybenzenes, aminophenols, hindered phenols, or ether or ester derivatives thereof derived from each of these compounds by sililation or alkylation of the phenolic hydroxy group thereof. Further, metal complexes represented by (bis-salicyaldoxymate) nickel complexes and (bis-N,N-dialkyldithiocarbamate) nickel complexes may be employed.

For the purpose of simplification and acceleration of processing, a color developing agent or a precursor thereof may be incorporated into the silver halide color photographic material used in the present invention. In order to incorporate color developing agents, it is preferred to employ various precursors of color developing agents in view of increase in stability of the color photographic material. Suitable examples of the precursors include indoaniline type compounds as described in U.S. Pat. Nos. 3,342,597, Schiff's base type compounds as described in U.S. Pat. No. 3,342,599 and *Research Disclosure,* No. 14850 (August 1976), and ibid., No. 15159 (November 1976), aldol compounds as described in *Research Disclosure,* No. 13924 (November 1975), metal salt complexes as described in U.S. Pat. No. 3,719,492, urethane type compounds as described in Japanese patent application (OPI) No. 135628/78, and various salt type precursors as described in Japanese patent application (OPI) No. 6235/81, 16133/81, 59232/81, 67842/81, 83734/81, 83735/81, 83736/81, 89735/81, 81837/81, 54430/81, 106241/81, 107236/81, 97531/82 and 83565/82, etc.

Further, the silver halide color photographic material used in the present invention may contain various 1-phenyl-3-pyrazolidones for the purpose of accelerating color development. Typical examples of the compounds are described in Japanese patent application (OPI) Nos. 64339/81, 144547/82, 211147/82, 50532/83, 50536/83, 50533/83, 50534/83, 50535/83 and 115438/83, etc.

In accordance with the method of the present invention, the process for desilveration can be conducted in an extremely short period of time. Therefore, the present invention has great importance to the goal of rapid processing.

The present invention is explained in greater detail with reference to the following examples, but the present invention should not be construed as being limited thereto.

EXAMPLE 1

On a cellulose triacetate film support provided with a subbing layer were coated layers having the compositions set forth below to prepare multilayer color photographic light-sensitive materials which were designated Samples 101 to 107.

With the compositions of the layers, coated amounts of silver halide and colloidal silver are shown in terms of the silver coated amount in units of g/m$^2$, those of couplers, additives and gelatin are also shown using a unit of g/m$^2$, and those of sensitizing dyes are shown using a molar amount per mol of silver halide present in the same layer. Further, the amounts of DIR couplers used are controlled so that gradation of each sample is almost same. The kinds and amounts of DIR couplers employed are summarized in Table 1 below.

| | |
|---|---|
| **First Layer: Antihalation Layer** | |
| Black colloidal silver | 0.2 |
| Gelatin | 1.3 |
| Colored Coupler C-1 | 0.06 |
| Ultraviolet Ray Absorbing Agent UV-1 | 0.1 |
| Ultraviolet Ray Absorbing Agent UV-2 | 0.2 |
| Dispersion Oil Oil-1 | 0.01 |
| Dispersion Oil Oil-2 | 0.01 |
| **Second Layer: Intermediate Layer** | |
| Fine grain silver bromide (average particle size: 0.07 μm) | 0.15 |
| Gelatin | 1.0 |
| Colored Coupler C-2 | 0.02 |
| Dispersion Oil Oil-1 | 0.1 |
| **Third Layer: First Red-Sensitive Emulsion Layer** | |
| Silver iodobromide emulsion (silver iodide: 2 mol %, average particle size: 0.3 μm) | 0.4 |
| Gelatin | 0.6 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-3 | 0.06 |
| Coupler C-4 | 0.06 |
| DIR Coupler | Shown in Table 1 |
| Coupler C-2 | 0.03 |
| Dispersion Oil Oil-1 | 0.03 |
| Dispersion Oil Oil-3 | 0.012 |
| **Fourth Layer: Second Red-Sensitive Emulsion Layer** | |
| Silver iodobromide emulsion (silver iodide: 5 mol %, average particle size: 0.5 μm) | 0.7 |
| Gelatin | 1.0 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-3 | 0.24 |
| Coupler C-4 | 0.24 |
| DIR Coupler | Shown in Table 1 |
| Coupler C-2 | 0.04 |
| Dispersion Oil Oil-1 | 0.05 |
| Dispersion Oil Oil-3 | 0.10 |
| **Fifth Layer: Third Red-Sensitive Emulsion Layer** | |
| Silver iodobromide emulsion (silver iodide: 10 mol %, average particle size: 0.7 μm) | 1.0 |
| Gelatin | 1.0 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-6 | 0.05 |
| Coupler C-7 | 0.1 |
| Coupler C-2 | 0.03 |
| Dispersion Oil Oil-1 | 0.01 |
| Dispersion Oil Oil-2 | 0.05 |
| **Sixth Layer: Intermediate Layer** | |
| Gelatin | 1.0 |
| Compound Cpd-A | 0.03 |
| Dispersion Oil Oil-1 | 0.05 |
| **Seventh Layer: First Green-Sensitive Emulsion Layer** | |
| Silver iodobromide emulsion (silver iodide: 4 mol %, average particle size: 0.3 μm) | 0.3 |
| Sensitizing Dye IV | $5 \times 10^{-4}$ |
| Sensitizing Dye V | $2 \times 10^{-4}$ |
| Gelatin | 1.0 |
| Coupler C-9 | 0.2 |
| DIR Coupler | Shown in Table 1 |
| Coupler C-1 | 0.03 |
| Dispersion oil Oil-1 | 0.5 |
| **Eighth Layer: Second Green-Sensitive Emulsion Layer** | |
| Silver iodobromide emulsion (silver iodide: 5 mol %, average particle size: 0.5 μm) | 0.4 |
| Gelatin | 1.0 |
| Sensitizing Dye VI | $5 \times 10^{-4}$ |
| Sensitizing Dye V | $2 \times 10^{-4}$ |
| Coupler C-9 | 0.25 |
| Coupler C-1 | 0.03 |
| Coupler C-10 | 0.015 |

-continued

| | |
|---|---|
| DIR Coupler | Shown in Table 1 |
| Dispersion Oil Oil-1 | 0.2 |
| **Ninth Layer: Third Green-Sensitive Emulsion Layer** | |
| Silver iodobromide emulsion (silver iodide: 6 mol %, average particle size: 0.7 μm) | 0.85 |
| Gelatin | 1.0 |
| Sensitizing Dye IV | $3.5 \times 10^{-4}$ |
| Sensitizing Dye V | $1.4 \times 10^{-4}$ |
| Coupler C-11 | 0.05 |
| Coupler C-12 | 0.01 |
| Coupler C-13 | 0.08 |
| Coupler C-1 | 0.02 |
| Dispersion Oil Oil-1 | 0.10 |
| Dispersion Oil Oil-2 | 0.05 |
| **Tenth Layer: Yellow Filter Layer** | |
| Gelatin | 1.2 |
| Yellow colloidal silver | 0.08 |
| Compound Cpd-B | 0.1 |
| Dispersion Oil Oil-1 | 0.3 |
| **Eleventh Layer: First Blue-Sensitive Emulsion Layer** | |
| Monodispersed silver iodobromide emulsion (silver iodide: 4 mol %, average particle size: 0.3 μm) | 0.4 |
| Gelatin | 1.0 |
| Sensitizing Dye V | $2 \times 10^{-4}$ |
| Coupler C-14 | 0.9 |
| DIR Coupler | Shown in Table 1 |
| Dispersion Oil Oil-1 | 0.2 |

-continued

| | |
|---|---|
| **Twelfth Layer: Second Blue-Sensitive Emulsion Layer** | |
| Silver iodobromide emulsion (silver iodide: 10 mol %, average particle size: 1.5 μm) | 0.5 |
| Gelatin | 0.6 |
| Sensitizing Dye V | $1 \times 10^{-4}$ |
| Coupler C-14 | 0.25 |
| Dispersion Oil Oil-1 | 0.07 |
| **Thirteenth Layer: First Protective Layer** | |
| Gelatin | 0.8 |
| Ultraviolet Ray Absorbing Agent UV-1 | 0.1 |
| Ultraviolet Ray Absorbing Agent UV-2 | 0.2 |
| Dispersion Oil Oil-1 | 0.01 |
| Dispersion Oil Oil-2 | 0.01 |
| **Fourteenth Layer: Second Protective Layer** | |
| Gelatin | 0.45 |
| Polymethyl methacrylate particle (diameter: 1.5 μm) | 0.2 |
| Hardening Agent H-1 | 0.4 |
| Formaldehyde Scavenger S-1 | 0.5 |
| Formaldehyde Scavenger S-2 | 0.5 |

A surface active agent was added to each of the layers as a coating aid in addition to the above described components.

The chemical structural formula or chemical names of the compounds employed for preparing the above-described samples are shown below.

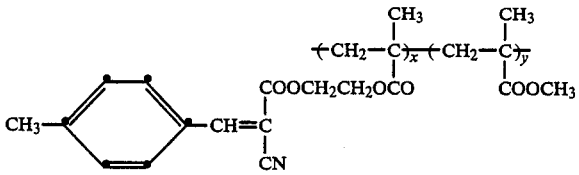

wherein x/y = 7/3 (weight ratio)

UV-1

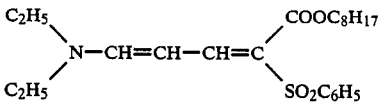

UV-2

Oil-1: Tricresyl phosphate
Oil-2: Dibutyl phthalate
Oil-3: Bis(2-ethylhexyl)phthalate

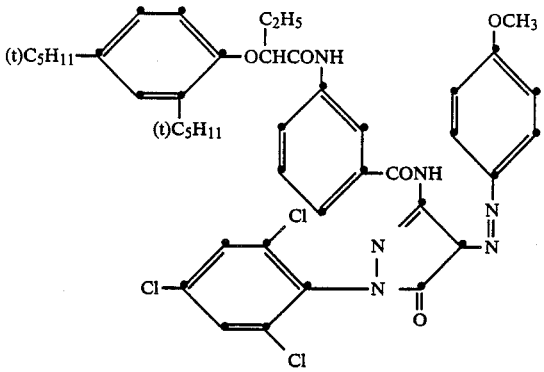

Coupler C-1

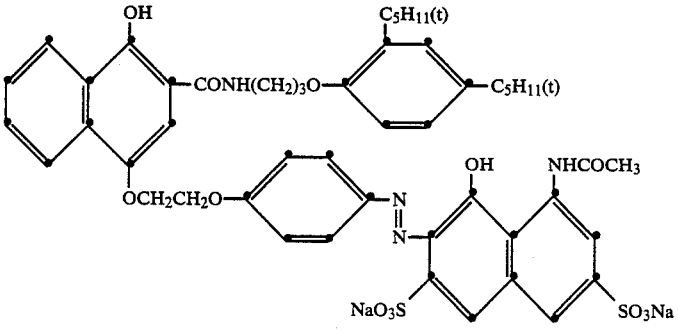

Coupler C-2

-continued
Coupler C-3
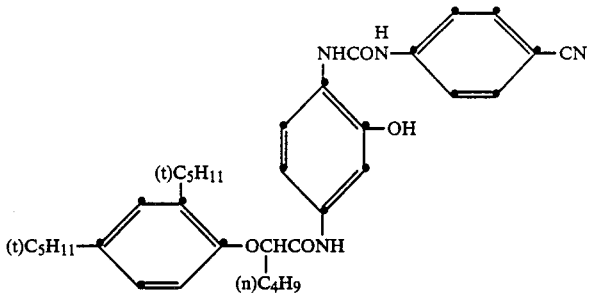
Coupler C-4
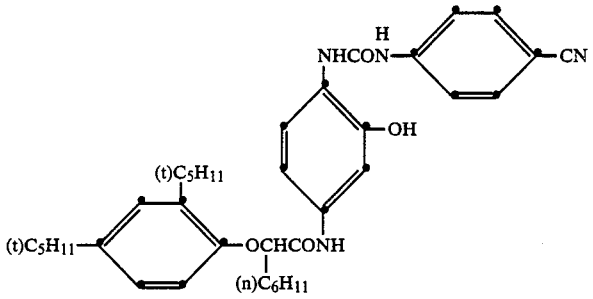
Coupler C-6
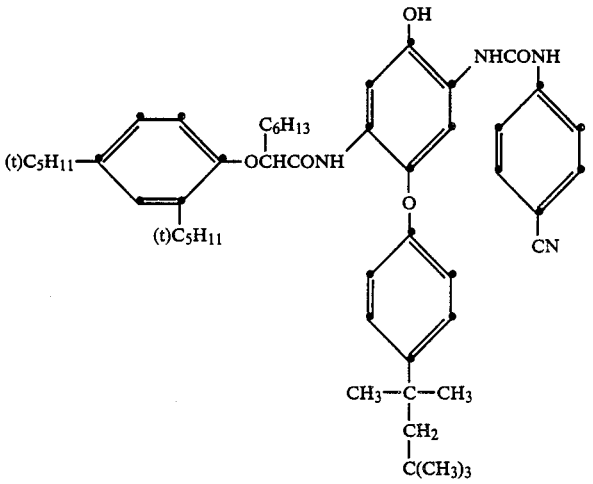
Coupler C-7
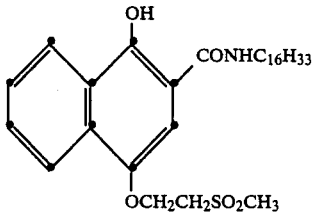
Coupler C-9
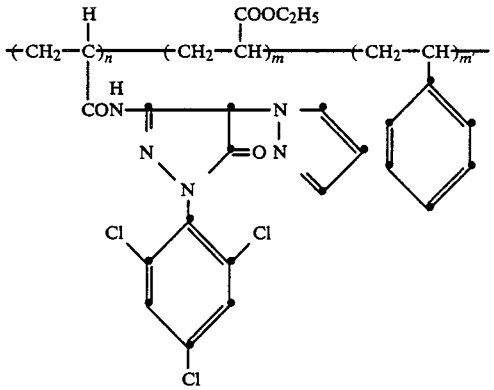
wherein n/m + m' = 1 (weight ratio)
m/m' = 1 (weight ratio)
molecular weight about 20,000

-continued
Coupler C-10
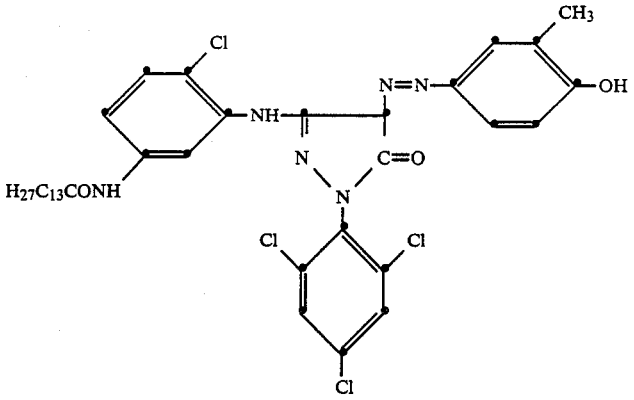
Coupler C-11
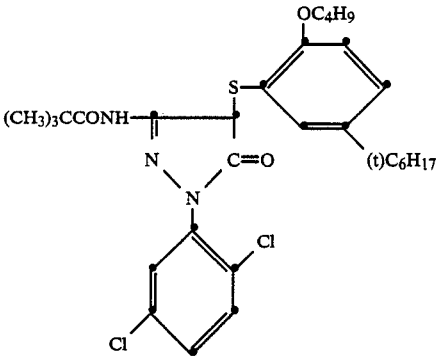
Coupler C-12
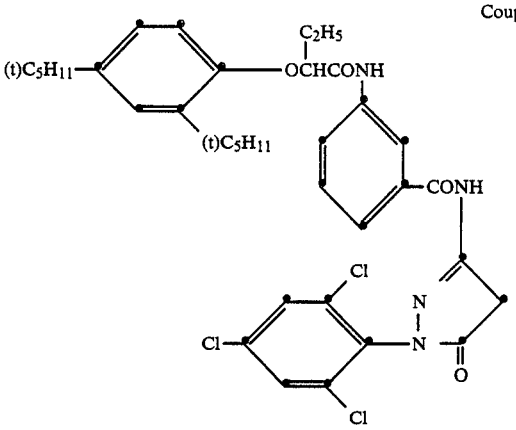
Coupler C-13
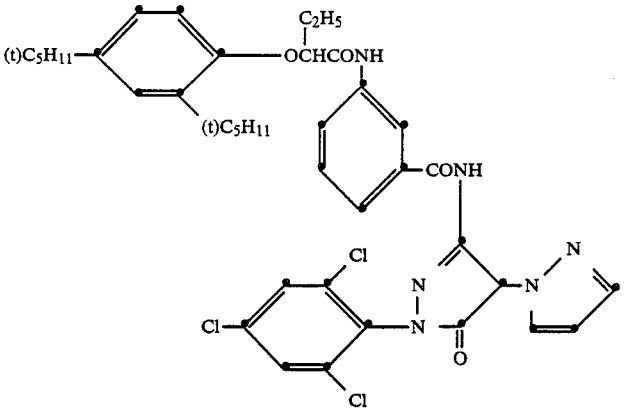
Coupler C-14
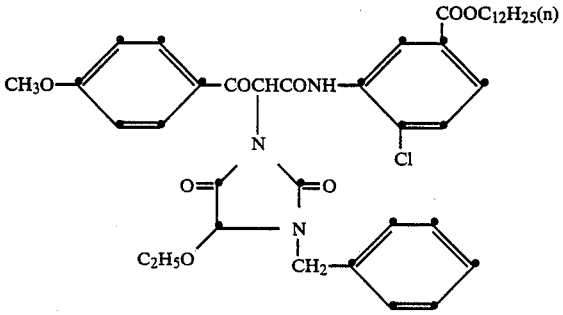

-continued
Cpd A
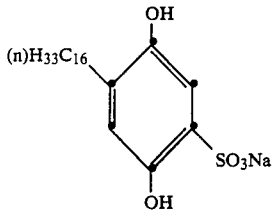
Cpd B
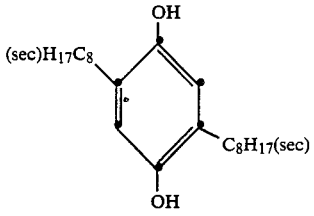
Sensitizing Dye I
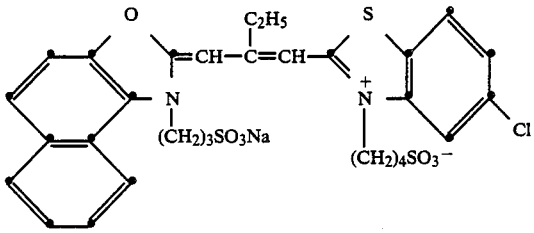
Sensitizing Dye II
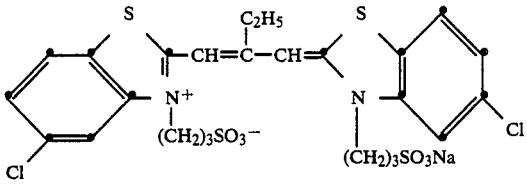
Sensitizing Dye III
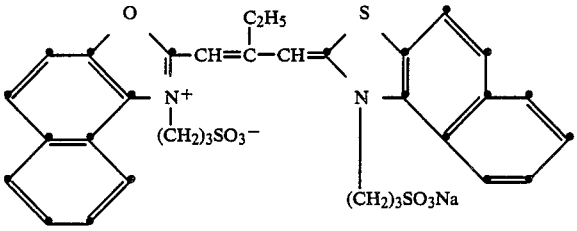
Sensitizing Dye IV
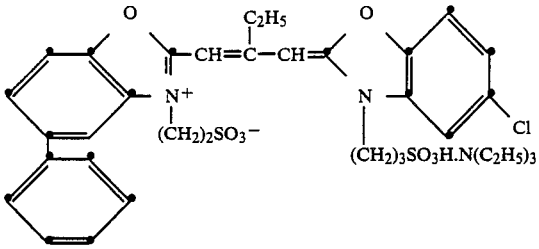
Sensitizing Dye V
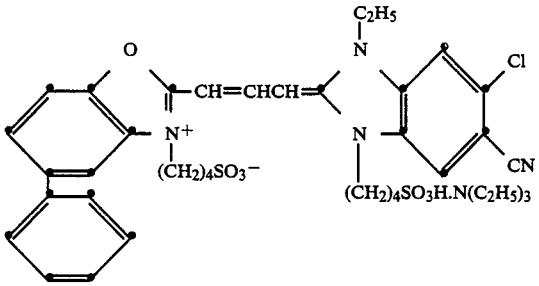
Sensitizing Dye VI
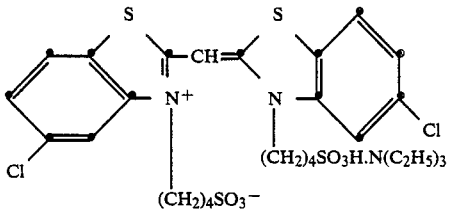

-continued

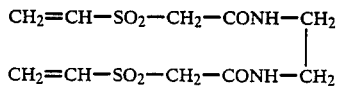

H-1

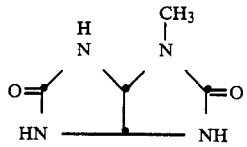

S-1

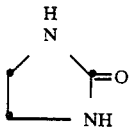

S-2

DIR Coupler A R = $NHCO(t)C_5H_{11}$
B R = Br
D R = $COOCH_2CH_2OC_2H_5$

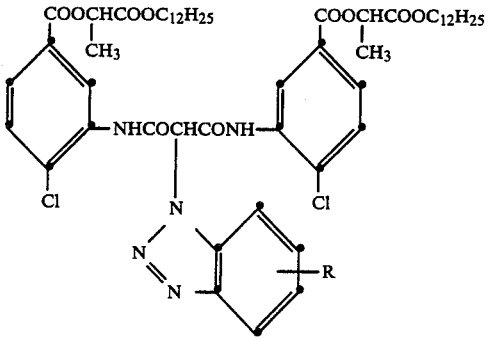

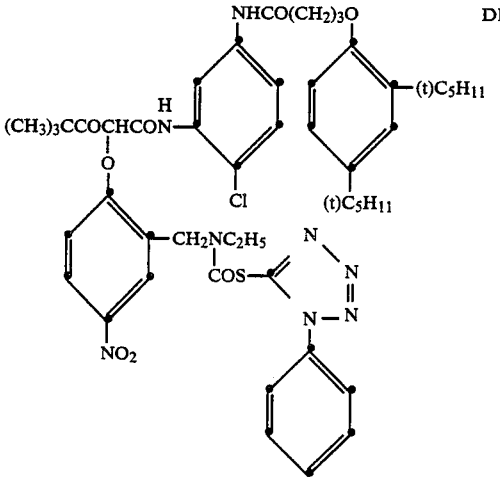

DIR Coupler C

These color photographic materials were exposed to light in an exposure amount of 25 CMS (Candela Meter Second) using a tungsten light source and a filter to adjust the color temperature to 4,800° K., and then subjected to development processing at 38° C. according to the following processing step A or B.

| Processing Step | Processing A Time | Processing B Time |
|---|---|---|
| Color development | 3 min 15 sec | 3 min 15 sec |
| Bleaching | 2 min | 1 min |
| Fixing | 3 min 15 sec | — |
| Bleach-Fixing | — | 3 min 15 sec |
| Washing with water | 3 min 15 sec | 3 min 15 sec |
| Stabilizing | 1 min 05 sec | 1 min 05 sec |

The processing solutions used in Processing A and Processing B had the following compositions:

| | |
|---|---|
| Color Developing solution | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 liter |
| | pH 10.0 |
| Bleaching Solution | |
| Iron (III) Ammonium Ethylenediaminetetraacetate | 100 g |

-continued

| | |
|---|---|
| Disodium Ethylenediaminetetraacetate | 10.0 g |
| Ammonium Bromide | 150.0 g |
| Ammonium Nitrate | 10.0 g |
| Water to make | 1.0 liter |
| | pH 6.0 |
| Fixing Solution | |
| Disodium Ethylenediaminetetraacetate | 1.0 g |
| Sodium Sulfite | 4.0 g |
| Ammonium Thiosulfate (70% aq. soln.) | 250.0 ml |
| Sodium Bisulfite | 4.6 g |
| Water to make | 1.0 liter |
| | pH 6.6 |
| Bleach Fixing Solution | |
| Iron (III) Ammonium Ethylenediaminetetraacetate | 100 g |
| Disodium Ethylenediaminetetraacetate | 10.0 g |
| Sodium Sulfite | 15.0 g |
| Ammonium Thiosulfate (70% aq. soln.) | 250.0 g |
| Water to make | 1.0 liter |
| | pH 6.8 |
| Stabilizing Solution | |
| Formalin (40 wt % formaldehyde solution) | 2.0 ml |
| Polyoxyethylene-p-monononylphenylether (average degree of polymerization = about 10) | 0.3 g |
| Water to make | 1.0 liter |

The amount of remaining silver in the maximum density portion of each film sample subjected to the development processing as described above was measured according to X-ray fluorometric analysis. The results thus obtained are shown in Table 1 below.

TABLE 1

| Sample No. | DIR Coupler | 3rd layer | 4th layer | 7th layer | 8th layer | 11th layer | Half-life Period (min) | Amount of Remaining Silver ($\mu g/cm^2$) Processing A | Processing B |
|---|---|---|---|---|---|---|---|---|---|
| 101 (Comparative Comparison) | A | 0.04 | 0.04 | 0.03 | 0.03 | 0.07 | not decomposed | 10.3 | 15.7 |
| 102 | B | 0.05 | 0.06 | 0.04 | 0.04 | 0.08 | " | 10.6 | 17.2 |

TABLE 1-continued

| Sample No. | DIR Coupler | 3rd layer | 4th layer | 7th layer | 8th layer | 11th layer | Half-life Period (min) | Amount of Remaining Silver ($\mu g/cm^2$) Processing A | Processing B |
|---|---|---|---|---|---|---|---|---|---|
| (Comparative Comparison) 103 (Comparative Comparison) | C | 0.04 | 0.04 | 0.03 | 0.03 | 0.07 | " | 11.5 | 16.3 |
| 104 (Present Invention) | (2) | 0.04 | 0.04 | 0.03 | 0.03 | 0.07 | 4.5 | 10.0 | 3.0 |
| 105 (Present Invention) | (13) | 0.04 | 0.04 | 0.03 | 0.03 | 0.07 | 11.0 | 11.7 | 4.7 |
| 106 (Present Invention) | (27) | 0.04 | 0.04 | 0.03 | 0.03 | 0.07 | 4.5 | 10.1 | 3.4 |
| 107 (Comparative Comparison) | D | 0.04 | 0.04 | 0.03 | 0.03 | 0.07 | 540 | 10.9 | 15.2 |

As is apparent from the results shown in Table 1, the samples exhibit almost same level of desilvering property in the case of Processing A, which is conventionally known, irrespective of using the hydrolyzable type DIR coupler according to the present invention. On the contrary, in Processing B, the desilvering property is extremely good when the hydrolyzable DIR coupler is employed in comparison with the cases wherein the hydrolyzable DIR coupler is not used. These results clearly illustrate the superior effect of the present invention.

EXAMPLE 2

The same procedure as described in Example 1 was conducted using Samples 101 to 107 except that Bleach Accelerator (1) or (2) described below was added to the bleaching solution described in Example 1 in an amount of $1\times10^{-2}$ mol per liter. The amount of remaining silver in each sample after processing was determined in the same manner as described in Example 1. The results thus obtained are shown in Table 2 below.

TABLE 2

| Sample No. | Amount of Remaining Silver ($\mu g/cm^2$) Bleach Accelerator (1) Processing A | Bleach Accelerator (1) Processing B | Bleach Accelerator (2) Processing A | Bleach Accelerator (2) Processing B |
|---|---|---|---|---|
| 101 (Comparative Comparison) | 5.7 | 8.7 | 8.9 | 8.8 |
| 102 (Comparative Comparison) | 5.5 | 8.9 | 8.9 | 8.7 |
| 103 (Comparative Comparison) | 5.8 | 8.8 | 8.6 | 8.5 |
| 104 (Present Invention) | 5.5 | 0.7 | 8.3 | 2.0 |
| 105 (Present Invention) | 5.8 | 1.0 | 8.5 | 2.2 |
| 106 (Present Invention) | 5.6 | 0.6 | 8.4 | 1.9 |
| 107 (Comparative Comparison) | 5.6 | 8.0 | 8.6 | 8.5 |

TABLE 2-continued

| Sample No. | Amount of Remaining Silver ($\mu g/cm^2$) Bleach Accelerator (1) Processing A | Bleach Accelerator (1) Processing B | Bleach Accelerator (2) Processing A | Bleach Accelerator (2) Processing B |
|---|---|---|---|---|

Bleach Accelerator (1):

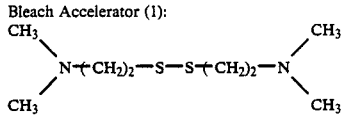

Bleach Accelerator (2)

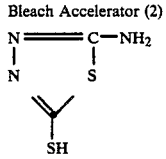

As is apparent from the results shown in Table 2, it is clear that the method of the present invention in which the photographic light-sensitive material containing the hydrolyzable type DIR coupler is treated using Processing B, exhibits excellent desilvering property in the cases wherein the bleach accelerator is added to the bleaching bath.

EXAMPLE 3

The same procedure as described in Example 1 was conducted except using the same amount of iron (III) ammonium diethylenetriaminepentaacetate in place of iron (III) ammonium ethylenediaminetetraacetate contained in the bleaching bath and the bleach-fixing bath. Substantially similar results to those shown in Example 1 were obtained.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material, which comprises color developing an exposed silver halide color photographic material containing an alkali hydrolyzable type DIR coupler, rapidly processing the developed silver halide color photographic material with a liquid having a bleaching ability, and subsequently with a liquid having a bleach-fixing ability, to thereby form a color image.

2. A method for processing a silver halide color photographic material as in claim 1, wherein the hydrolyzable type DIR coupler is a DIR coupler or precursor thereof capable of releasing a development inhibitor, and which has a half-life period at a pH 10.0 of 4 hours or less.

3. A method for processing a silver halide color photographic material as in claim 2, wherein the half-life period of the DIR coupler at a pH of 10.0 is 2 hours or less.

4. A method for processing a silver halide color photographic material as in claim 1, wherein the hydrolyzable type DIR coupler is represented by formula (I)

$$A\text{-}[(L_1)_a\text{—}Z\text{-}(L_2\text{—}Y)_b]_m \qquad (I)$$

wherein A represents a coupler residue; Z represents a fundamental portion of a compound having a development inhibiting function which is connected directly (when a is 0) or through a linking group $L_1$ (when a 1) to the coupling position of the coupler; Y is connected to Z through a linking group $L_2$ and represents a substituent capable of generating the development inhibiting function of Z; $L_1$ represents a linking group; $L_2$ represents a linking group including a chemical bond which is cleaved in a developing solution; a represents 0 or 1; b represents 1 or 2, and when b represents 2, the two —$L_2$—Y groups may be the same or different; and m represents 1 or 2.

5. A method for processing a silver halide color photographic material as in claim 4, wherein the coupler residue represented by A is a coupler residue derived from a yellow color image forming coupler, a magenta color image forming coupler, a cyan color image forming coupler, or a non-color image forming coupler.

6. A method for processing a silver halide color photographic material as in claim 4, wherein the fundamental portion represented by Z is a divalent nitrogen-containing heterocyclic group or a nitrogen-containing heterocyclic thio group.

7. A method for processing a silver halide color photographic material as in claim 6, wherein the nitrogen-containing heterocyclic thio group is a tetrazolylthio group, a benzothiazolylthio group, a benzimidazolylthio group, a triazolylthio group, or an imidazolylthio group.

8. A method for processing a silver halide color photographic material as in claim 4, wherein the hydrolyzable type DIR coupler is represented by one of the formulae

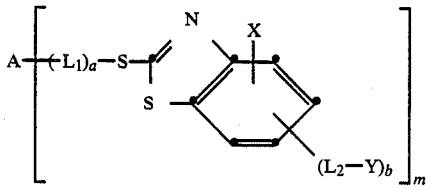

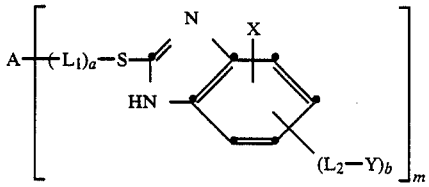

-continued

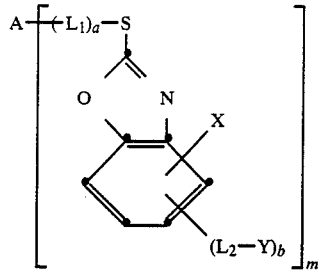

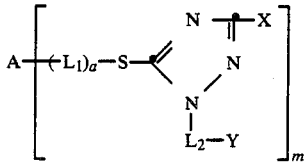

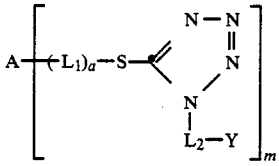

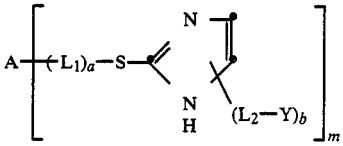

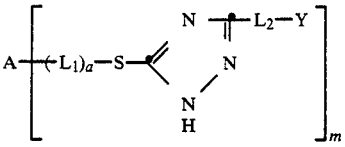

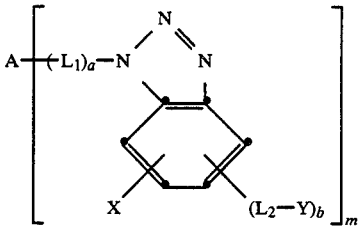

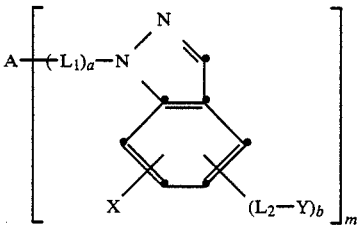

-continued

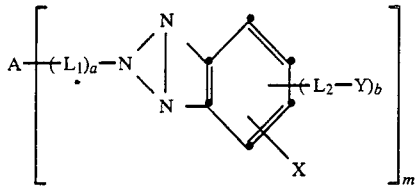

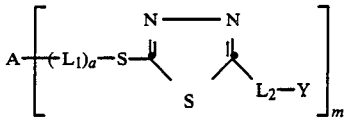

wherein A, $L_1$, a, $L_2$, Y, b and m each has the same meaning as defined for formula (I); and X represents a hydrogen atom, a halogen atom, an alkyl group, an alkenyl group, an alkanamido group, an alkenamido group, an alkoxy group, a sulfonamido group, or an aryl group.

9. A method for processing a silver halide color photographic material as in claim 4, wherein the substituent represented by Y is an alkyl group, a cycloalkyl group, an alkenyl group, a cycloalkenyl group, an aryl group, an aralkyl group, or a heterocyclic group.

10. A method for processing a silver halide color photographic material as in claim 4, wherein the hydrolyzable type DIR coupler is represented by one of the formulae $A\text{-}(OCH_2\text{-}Z\text{-}(L_2\text{-}Y)_b)_m$ $A\text{-}(SCH_2\text{-}Z\text{-}(L_2\text{-}Y)_b)_m$ $A\text{-}(O\overset{O}{\overset{\|}{C}}\text{-}Z\text{-}(L_2\text{-}Y)_b)_m$

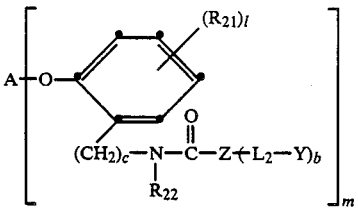

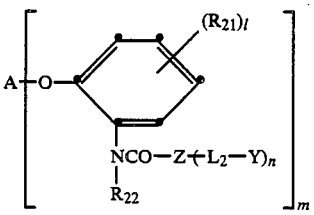

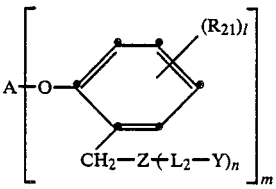

-continued

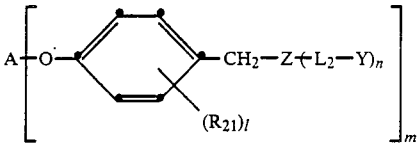

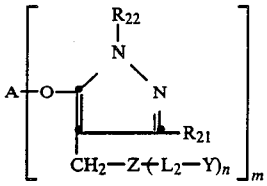

wherein $R_{21}$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a cycloalkyl group, an alkanesulfonyl group, an arylsulfonyl group, or an acyl group; $R_{22}$ represents a hydrogen atom, an alkyl group, an alkenyl group, an aralkyl group, a cycloalkyl group or an aryl group; c represents an integer from 0 to 2; n and l each represents 1 or 2, and when l represents 2, two $R_{21}$ groups may be bonded to each other to form a condensed ring.

11. A method for processing a silver halide color photographic material as in claim 4, wherein the moiety forming the linking group represented by $L_2$ is —COO—, —NHCOO—, —$SO_2O$—, —$OCH_2CH_2SO_2$—, $-O\underset{\underset{O}{\|}}{C}O-$ or $-NH\underset{\underset{O}{\|}}{C}\underset{\underset{O}{\|}}{C}O-$.

12. A method for processing a silver halide color photographic material as in claim 4, wherein the linking group represented by $L_2$ and the bonding thereof to Z and Y is represented by one of the formulae $-Z-(CH_2)_d-COO-Y$ $-Z-(CH_2)_d-O\overset{O}{\overset{\|}{C}}-Y$

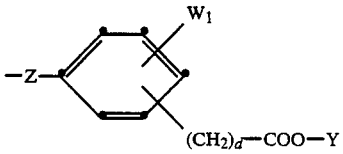

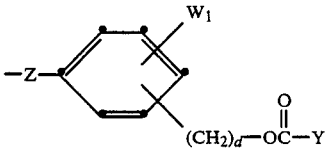

$-Z-(CH_2)_d-NHCOO-Y$

-continued

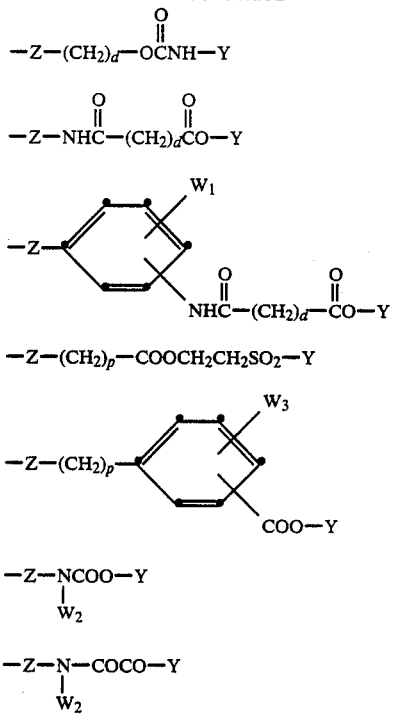

wherein d represents an integer from 0 to 10; $W_1$ represents a hydrogen atom, a halogen atom, an alkyl group having from 1 to 10 carbon atoms, an alkanamido group having from 1 to 10 carbon atoms, an alkoxy group having from 1 to 10 carbon atoms, an alkoxycarbonyl group having from 1 to 10 carbon atoms, an aryloxycarbonyl group, an alkanesulfonamido group having from 1 to 10 carbon atoms, an aryl group, a carbamoyl group, a nitro group, a cyano group, an arylsulfonamido group, a sulfamoyl group, or an imido group; $W_2$ represents a hydrogen atom, an alkyl group having from 1 to 6 carbon atoms, an aryl group, or an alkenyl group; $W_3$ represents a hydrogen atom, a halogen atom, a nitro group, an alkoxy group having from 1 to 6 carbon atoms or an alkyl group having from 1 to 6 carbon atoms; and p represents an integer of from 0 to 6.

13. A method for processing a silver halide color photographic material as in claim 4, wherein the hydrolyzable type DIR coupling is represented by formula (II), (III), (IV), (V), (VI), (VII), or (VIII)

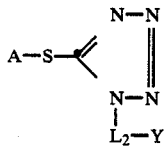

(II)

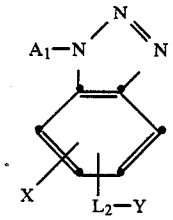

(III)

-continued

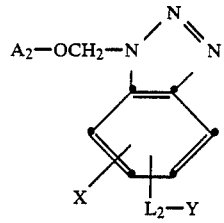

(IV)

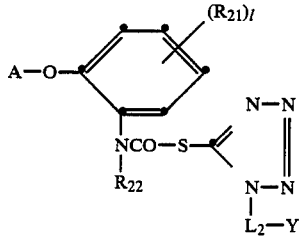

(V)

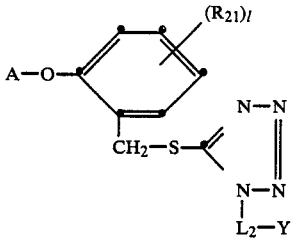

(VI)

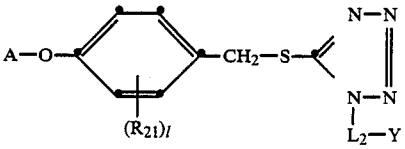

(VII)

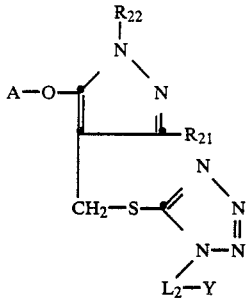

(VIII)

wherein A, $L_2$, and Y each has the same meaning as defined for formula (I); $A_1$ represents a coupler residue as defined for A in formula (I), excluding cyan color image forming coupler residues; $A_2$ represents a cyan color-image-forming coupler residue of the coupler residues as defined for A in formula (I); X represents a hydrogen atom, a halogen atom, an alkyl group, an alkenyl group, an alkanamido group, an alkenamido group, an alkoxy group, a sulfonamido group, or an aryl group; $R_{21}$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a cycloalkyl group, an alkanesulfonyl group, an arylsulfonyl group or an acyl group; $R_{22}$ represents a hydrogen atom, an alkyl group, an alkenyl group, an aralkyl group, a cycloalkyl group or an aryl group; and when l represents 2, the two $R_{21}$ groups may be bonded to each other to form a condensed ring.

14. A method for processing a silver halide color photographic material as in claim 1, wherein the liquid having a bleaching ability is a bleaching liquid which contains a bleaching agent and has an ability of bleaching developed silver.

15. A method for processing a silver halide color photographic material as in claim 1, wherein the liquid having a bleaching ability is a bleaching liquid capable of bleaching at least more than ½ of the maximum amount of developed silver contained in the color photographic light-sensitive material.

16. A method for processing a silver halide color photographic material as in claim 1, wherein an overflow solution of the bleaching liquid is introduced directly into the bleach-fixing liquid.

17. A method for processing a silver halide color photographic material as in claim 1, wherein a bleaching agent contained in the bleaching liquid and the bleach-fixing liquid is an aminopolycarboxylic acid ferric ion complex salt which is a complex of ferric ion and an aminopolycarboxylic acid or a salt thereof.

18. A method for processing a silver halide color photographic material as in claim 17, wherein the aminopolycarboxylic acid or salt thereof is ethylenediaminetetraacetic acid, disodium ethylenediaminetetraacetate, diammonium ethylenediaminetetraacetate, diethylenetriaminepentaacetic acid, or cyclohexanediaminetetraacetic acid.

19. A method for processing a silver halide color photographic material as in claim 1, wherein the bleaching liquid or the bleach-fixing liquid further contains a bleach accelerator.

20. A method for processing a silver halide color photographic material as in claim 1, wherein the silver halide color photographic material containing at least one blue-sensitive silver halide emulsion layer, at least one green-sensitive silver halide emulsion layer, and at least one red-sensitive silver halide emulsion layer.

* * * * *